US010466644B2

(12) United States Patent
Yano

(10) Patent No.: US 10,466,644 B2
(45) Date of Patent: Nov. 5, 2019

(54) EXPOSURE WINDOW COMPONENT, AND EXPOSURE DEVICE AND IMAGE FORMING APPARATUS USING THE SAME

(71) Applicant: FUJI XEROX CO., LTD., Tokyo (JP)

(72) Inventor: Kenichiro Yano, Kanagawa (JP)

(73) Assignee: FUJI XEROX CO., LTD., Minato-ku, Tokyo (JP)

( * ) Notice: Subject to any disclaimer, the term of this patent is extended or adjusted under 35 U.S.C. 154(b) by 189 days.

(21) Appl. No.: 15/587,497

(22) Filed: May 5, 2017

(65) Prior Publication Data

US 2018/0101126 A1 Apr. 12, 2018

(30) Foreign Application Priority Data

Oct. 12, 2016 (JP) ..... 2016-201137

(51) Int. Cl.
*G03G 21/16* (2006.01)
*G03G 15/04* (2006.01)

(52) U.S. Cl.
CPC ..... *G03G 21/1666* (2013.01); *G03G 15/04* (2013.01); *G03G 2221/1636* (2013.01)

(58) Field of Classification Search
None
See application file for complete search history.

(56) References Cited

U.S. PATENT DOCUMENTS 6,308,024 B1 * 10/2001 Nakayama ..... B41J 29/12 399/92

FOREIGN PATENT DOCUMENTS

JP 11-267643 A 10/1999
JP 2015-022019 A 2/2015

* cited by examiner

*Primary Examiner* — Roy Y Yi
(74) *Attorney, Agent, or Firm* — Sughrue Mion, PLLC

(57) ABSTRACT

An exposure window component is provided so as to be separated from an exposure device housing and is attached to an opening through which light from the exposure device housing passes. The exposure window component includes: a transmitting member that allows light from the exposure device housing to pass therethrough; a holding frame that holds the transmitting member; a receiving member that is provided at a periphery of the opening to receive the holding frame when the transmitting member is attached and that removably supports the transmitting member; and a grasping part that is provided at a portion of the holding frame and is grasped when the transmitting member is attached and removed.

15 Claims, 25 Drawing Sheets

EXPOSURE WINDOW COMPONENT, AND EXPOSURE DEVICE AND IMAGE FORMING APPARATUS USING THE SAME

CROSS-REFERENCE TO RELATED APPLICATIONS

This application is based on and claims priority under 35 U.S.C. 119 from Japanese Patent Application No. 2016-201137 filed Oct. 12, 2016.

BACKGROUND

Technical Field

The present invention relates to an exposure window component used in an exposure device, and an exposure device and an image forming apparatus using the same.

SUMMARY

According to an aspect of the invention, there is provided an exposure window component that is provided so as to be separated from an exposure device housing and that is attached to an opening through which light from the exposure device housing passes, the exposure window component including: a transmitting member that allows light from the exposure device housing to pass therethrough; a holding frame that holds the transmitting member; a receiving member that is provided at a periphery of the opening to receive the holding frame when the transmitting member is attached and that removably supports the transmitting member; and a grasping part that is provided at a portion of the holding frame and is grasped when the transmitting member is attached and removed.

BRIEF DESCRIPTION OF THE DRAWINGS

Exemplary embodiment of the present invention will be described in detail based on the following figures, wherein.

DETAILED DESCRIPTION

Outline of Exemplary Embodiment

Figure 1A:
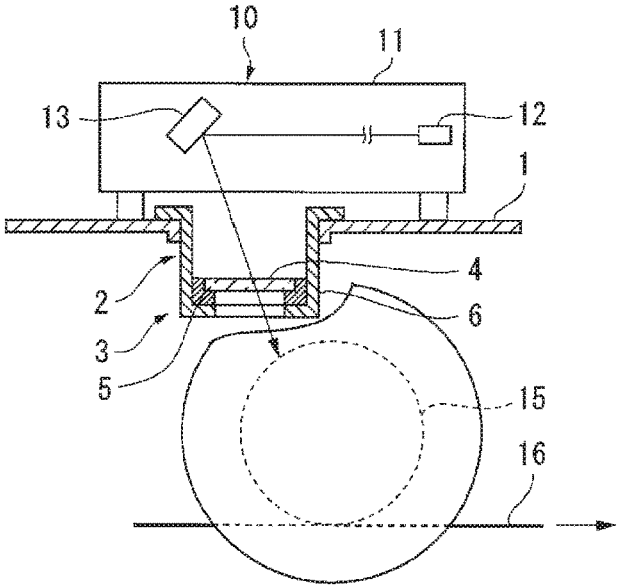
FIG. 1A shows the outline of an exemplary embodiment of an image forming apparatus including an exposure device that has an exposure window component to which the present invention is applied.
Figure 1B:
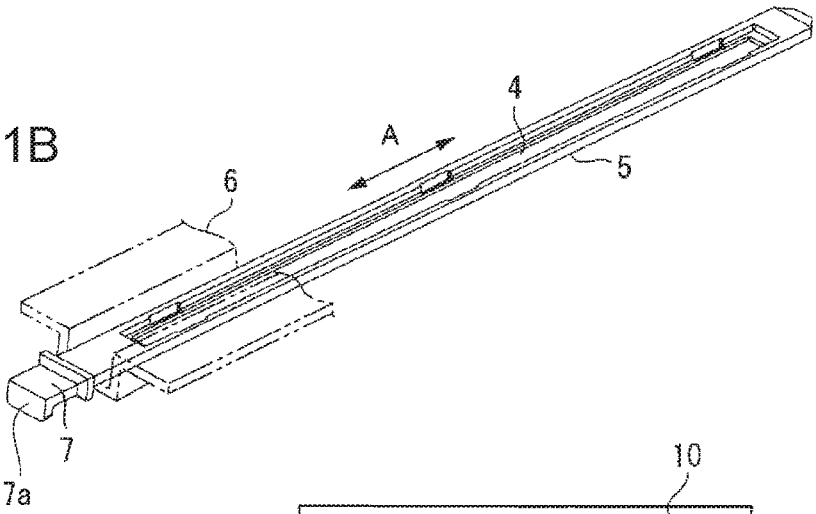
FIG. 1B shows an example of the exposure window component used in the exemplary embodiment.
Figure 1C:
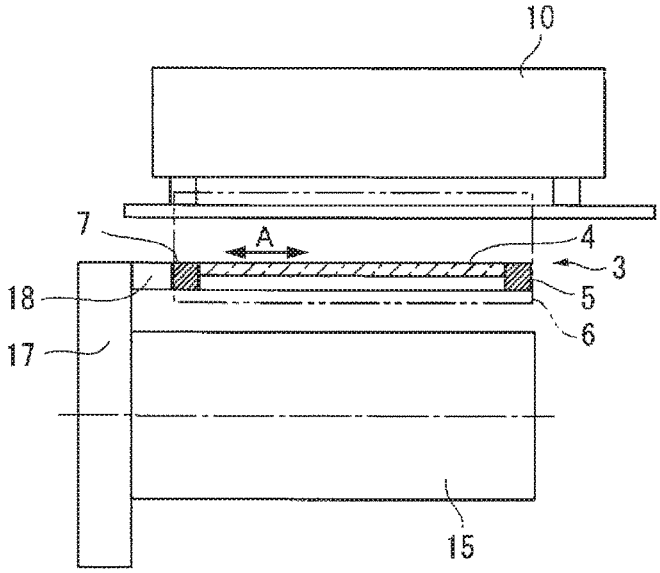
FIG. 1C shows an example of the use of the exposure window component according to the exemplary embodiment.

FIGS. 1A to 1C show the outline of an exemplary embodiment of an image forming apparatus to which the present invention is applied.

In FIGS. 1A to 1C, the image forming apparatus includes an image carrier 15 that carries an electrostatic latent image, and an exposure device 10 that is disposed above the image carrier 15 and radiates light onto the image carrier 15 to form an electrostatic latent image thereon. In the image forming apparatus, the electrostatic latent image formed on the image carrier 15 is made visible by a developing device (not shown) and is transferred to a recording material 16 by a transfer device (not shown).

In this example, the exposure device 10 includes an exposure device housing 11 disposed on a support member 1, an exposure light source 12 provided in the exposure device housing 11, an optical component 13 that is provided in the exposure device housing 11 and guides light from the light source 12 to the outside of the exposure device housing 11 along a predetermined optical path, and an exposure window component 3 that allows the light from the exposure device housing 11 to pass therethrough. Herein, the optical component 13 widely includes a rotary polygon mirror, a lens, a reflecting mirror, etc. Note that the image carrier 15 only needs to form an electrostatic latent image with the exposure device 10, and it may be either drum-shaped or belt-shaped. Furthermore, when an image is transferred to the recording material 16, the image on the image carrier 15 may be either directly transferred or indirectly transferred via an intermediate transfer body.

The exposure window component 3 in this example is provided so as to be separated from the exposure device housing 11 and is attached to an opening 2 through which light from the exposure device housing 11 passes. The exposure window component 3 includes: a transmitting member 4 that allows light from the exposure device housing 11 to pass therethrough; a holding frame 5 that holds the transmitting member 4; a receiving member 6 that is provided at the periphery of the opening 2 to receive the holding frame 5 when the transmitting member 4 is attached and that removably supports the transmitting member 4; and a grasping part 7 that is provided at a portion of the holding frame 5 and is grasped when the transmitting member 4 is attached and removed.

In this technical component, the exposure window component 3 widely includes those provided so as to be separated from the exposure device housing 11 and attached to the opening 2 through which the light from the exposure device housing 11 passes. Because the exposure window component 3 in this example is provided so as to be separated from the exposure device housing 11, there is low risk of shaking or deforming the exposure device housing 11 when the transmitting member 4 is attached and removed, thus adversely affecting the optical component 13 in the exposure device housing 11.

Although the transmitting member 4 is basically made of glass, those made of synthetic resin are also included.

In addition, the holding frame 5 only needs to hold the transmitting member 4. Although it is desirable that the overall circumference of the transmitting member 4 be held to effectively prevent damage to the transmitting member 4, those partially having a non-holding region may also be used.

In addition, the receiving member 6 only needs to receive the holding frame 5 when the transmitting member 4 is attached. At this time, a configuration in which a portion of the transmitting member 4 is received when the holding frame 5 is received by the receiving member 6 is also included. Furthermore, the receiving structure of the holding frame 5 with respect to the receiving member 6 only needs to allow attachment and removal of the transmitting member 4.

Furthermore, to which part and in what form the grasping part 7 is provided on the holding frame 5 may be selected, as appropriate, as long as the grasping part 7 is grasped when the transmitting member 4 is attached and removed.

In this way, in this exemplary embodiment, because the transmitting member 4 of the exposure window component 3 is configured to be attachable and removable, the transmitting member 4 can be cleaned from both the front and rear sides by removing the transmitting member 4.

Next, representative and desirable aspects of the exposure device, in particular, the exposure window component 3, according to this exemplary embodiment will be described.

First, in a representative aspect of the exposure window component 3, the opening 2 is provided in the support member 1, on which the exposure device housing 11 is disposed, and serves as a passage opening, through which the light from the exposure device housing 11 passes. In this example, the exposure window component 3 is attached to the opening 2 (passage opening) provided in the support member 1, on which the exposure device housing 11 is disposed, and, because the exposure window component 3 is provided outside the exposure device housing 11, the transmitting member 4 can be easily attached or removed without needing to open the interior of the exposure device housing 11.

In another representative aspect of the exposure window component 3, the transmitting member 4 is formed as an elongated member extending along the opening 2, which is elongated, and the grasping part 7 is provided at one longitudinal end portion of the holding frame 5 for the transmitting member 4 and allows the insertion and removal of the transmitting member 4 in the longitudinal direction. In this aspect, the elongated transmitting member 4 is inserted and removed from one longitudinal end.

Furthermore, in a desirable aspect of the receiving member 6, the receiving member 6 has a guide part that guides the holding frame 5 in a sliding manner along the periphery of the opening 2. In this example, because the holding frame 5 is guided along the guide part of the receiving member 6, the attachment and removal of the transmitting member 4 can be smoothly performed.

Furthermore, in another desirable aspect of the receiving member 6, the receiving member 6 has a resin seal having low sliding resistance on the surface thereof that receives the holding frame 5. In this aspect, the resin seal is provided on the receiving surface of the receiving member 6, and, because the sliding (sliding movement) resistance of the resin seal is low, the frictional resistance with respect to the holding frame 5 can be reduced, and the airtightness between the receiving member 6 and the holding frame 5 can also be ensured to some extent by the resin seal.

Furthermore, in another desirable aspect of the receiving member 6, the receiving member 6 has, in a holding-frame receiving surface extending along the periphery of the opening 2, positioning parts that can position the holding frame 5 at several portions in the direction along the periphery of the opening 2 in the transmitting member 4. In this aspect, a transmitting-member positioning structure is added to the receiving member 6.

Furthermore, in another desirable aspect of the receiving member 6, the receiving member 6 includes a position detector for detecting whether the transmitting member 4 has been attached to a predetermined position. In this example, a transmitting-member position detector is incorporated into the receiving member 6. The position detector may be a microswitch, an optical sensor, or the like.

Furthermore, in a desirable aspect of the grasping part 7, the grasping part 7 has, at an end thereof, a tab 7*a* for enabling the transmitting member 4 to be pulled out. In this example, because the grasping part 7 has the tab 7*a*, which can be pulled out, at the end, an operator can easily pull out the transmitting member 4 by grasping the tab 7*a*.

Furthermore, in a desirable aspect of the image forming apparatus, as shown in FIG. 1C, the image carrier 15 can be inserted and removed in the rotation axis direction, and the exposure window component 3 allows the grasping part 7 to be grasped when the image carrier 15 has been removed. In this example, the grasping part 7 of the exposure window component 3 cannot be grasped when the image carrier 15 is attached, and the grasping part 7 of the exposure window component 3 can be grasped when the image carrier 15 is removed. Therefore, the image carrier 15 needs to be removed to remove the transmitting member 4 of the exposure window component 3, and the transmitting member 4 cannot be removed without the removal of the image carrier 15. Hence, even if foreign bodies fall through the opening 2 when the transmitting member 4 is removed, the foreign bodies do not fall on the image carrier 15.

Furthermore, in another desirable aspect of the image forming apparatus, as shown in FIG. 1C, the image carrier 15 has, at an end thereof in a direction in which it is removed, a protruding part 17 protruding in the radial direction, and the protruding part 17 has a projection 18 that presses the holding frame 5 of the exposure window component 3 to a predetermined position. In this example, when the transmitting member 4 is attached, even if the transmitting member 4 is improperly attached to a predetermined position, because the image carrier 15, which is set at a predetermined position, pushes the holding frame 5 to a predetermined position, the transmitting member 4 held by the holding frame 5 is set at the predetermined position.

The present invention will be described in more detail below on the basis of the exemplary embodiments shown in the attached drawings.

Exemplary Embodiment

Figure 2:
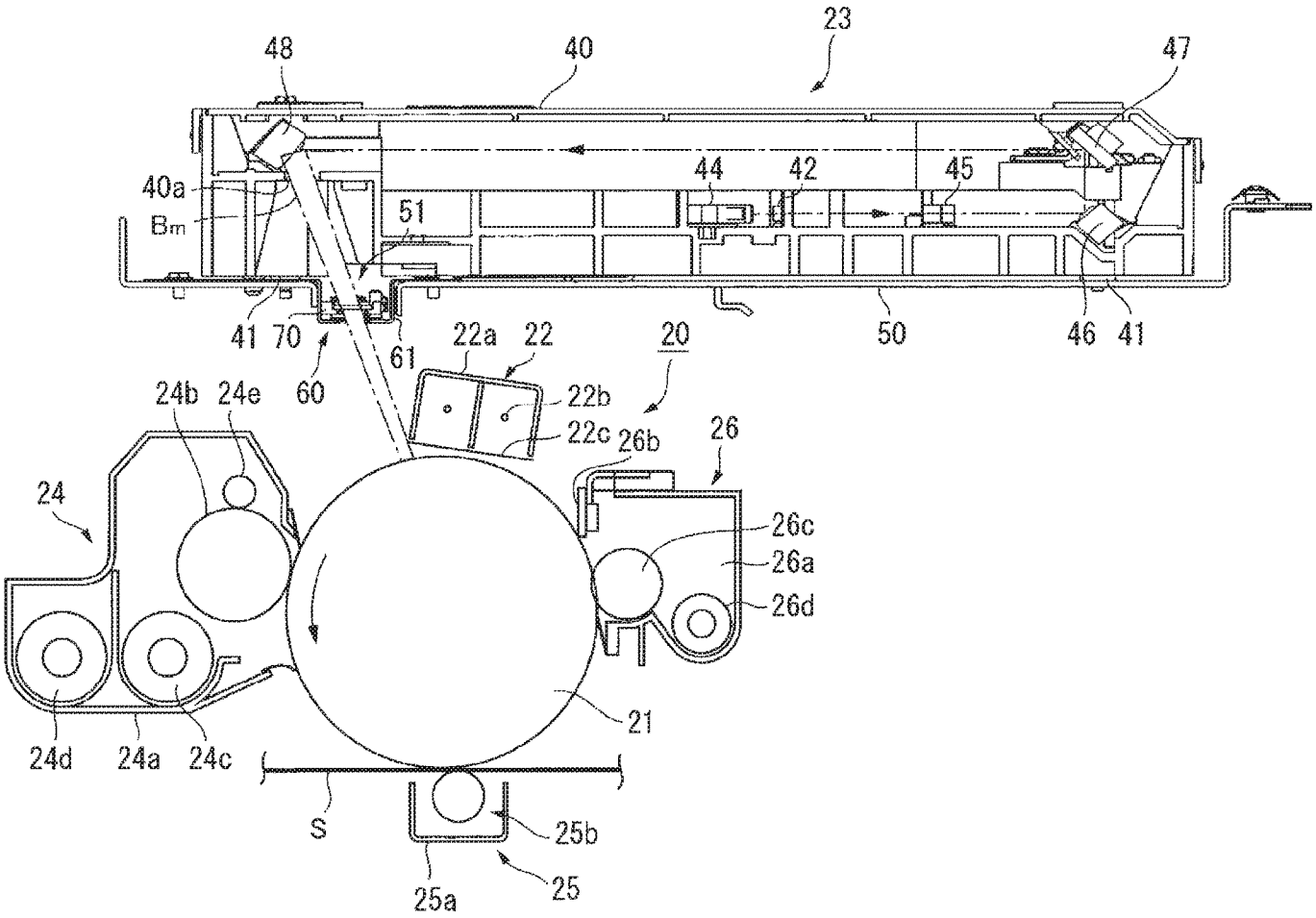
FIG. 2 shows the overall configuration of an image forming apparatus according to an exemplary embodiment.

FIG. 2 shows the overall configuration of an image forming apparatus according to an exemplary embodiment.

Overall Configuration of Image Forming Apparatus

In FIG. 2, an image forming apparatus 20 includes: a photoconductor 21, serving as a drum-shaped image carrier; a charging device 22 that charges the photoconductor 21; an exposure device 23 that exposes the charged photoconductor 21 on the basis of predetermined image information to form an electrostatic latent image thereon; a developing device 24 that develops the electrostatic latent image on the photoconductor 21 with toner, serving as image-forming particles; a transfer device 25 that transfers a toner image on the photoconductor 21 to a recording material S; and a cleaning device 26 that cleans the residual toner on the photoconductor 21 that has passed through a transfer portion of the transfer device 25.

Component Other than Exposure Device

In this example, the charging device 22 is a non-contact-type corona charger that includes: a charging housing 22*a*; multiple (in this example, two) charging wires 22*b* provided in the charging housing 22*a*; and a grid electrode 22*c* for controlling, which is disposed between the charging housing 22*a* and the wires 22*b* and that charges the circumference of the photoconductor 21 to a predetermined charging electric potential. However, the charging device 22 is not limited to thereto, and the design may be changed, as appropriate, such that, for example, a roller-shaped charging member is disposed in contact with the photoconductor.

Furthermore, the developing device 24 includes: a developer housing 24*a*, which can accommodate developer that is made of, for example, toner and carrier and which has an opening facing the photoconductor 21; a developing roller 24*b* that is disposed in the opening in the developer housing 24*a* and is subjected to a developing electric field; developer stirring members 24*c* and 24*d* that are paired, for example, and are disposed inside the developer housing 24*a*, at a rear side of the developing roller 24*b*; and a layer-thickness restriction member 24*e* that is, for example, roller-shaped and can restrict the thickness of the layer of the developer held on the developing roller 24*b*, the layer-thickness restriction member 24*e* being disposed upstream of the developing roller 24*b* in the rotation direction. The developing device 24 develops the electrostatic latent image on the photoconductor 21 with the developer held on the developing roller 24*b*. However, the developing device 24 is not limited thereto, and the design may be changed, as appropriate, such that, for example, a one-component developer, which does not use carrier in the developer, is used, multiple developing rollers 24*b* are arranged side-by-side, or the developer stirring members are vertically disposed.

Furthermore, for example, the transfer device 25 includes: a transfer housing 25*a*; and a transfer roller 25*b* disposed therein so as to be in contact with and thus rotated by the photoconductor 21. The transfer device 25 transfers the toner image on the photoconductor 21 to a recording material S by applying a predetermined transfer electric field between the photoconductor 21 and the transfer roller 25*b*. However, the transfer device 25 is not limited thereto, and, for example, a non-contact-type charger using a corona charging method may also be used.

Furthermore, the cleaning device 26 includes: a cleaning housing 26*a* that can accommodate residue, such as residual toner, paper dust, etc.; a cleaning member 26*b*, which is, for example, plate-shaped and is disposed at the periphery of an opening in the cleaning housing 26*a*; and a roller-shaped or a brush-shaped cleaning member 26*c* disposed at a portion facing the opening in the cleaning housing 26*a*. The residue on the photoconductor 21 is cleaned with the cleaning members 26*b* and 26*c*, and the residue accommodated in the cleaning housing 26*a* is collected with the transport member 26*d* into a collection box (not shown) from one end of the cleaning housing 26*a*. However, the cleaning device 26 is not limited thereto, and the design may be changed, as appropriate, such that, for example, the type of the cleaning member or the cleaning method is changed.

Process Cartridge

Figure 4:
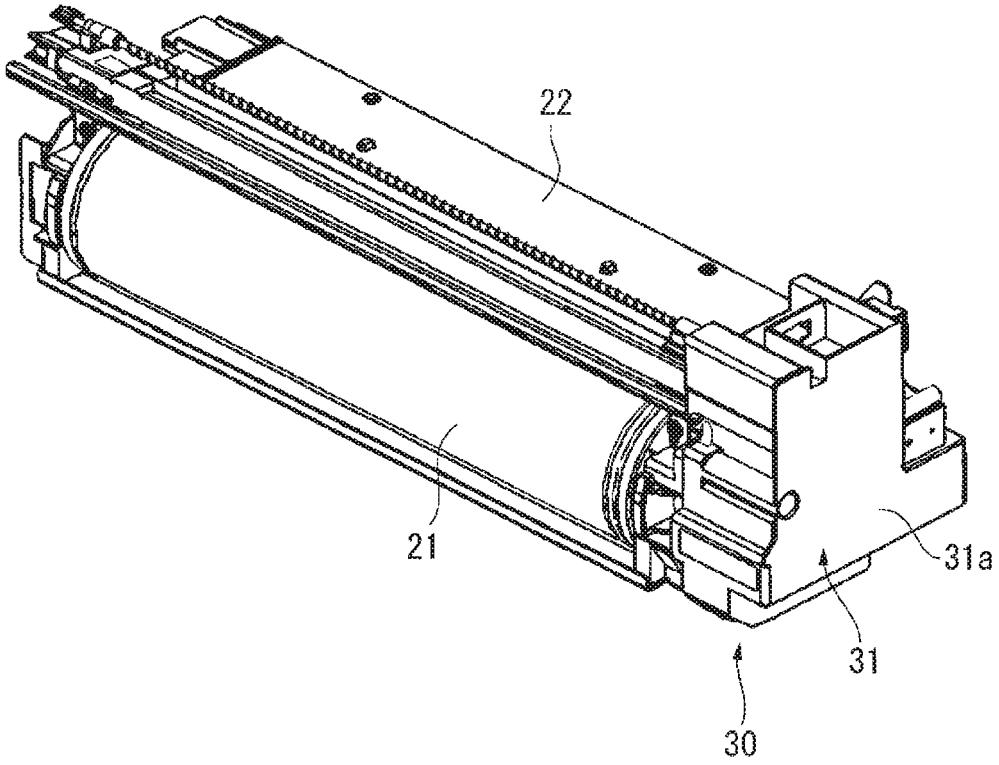
FIG. 4 shows a process cartridge used in the exemplary embodiment.

In this exemplary embodiment, as shown in FIG. 4, the photoconductor 21 is held by a cartridge housing 31. By incorporating, for example, the charging device 22 and the cleaning device 26 into the cartridge housing 31, a process cartridge 30, in which the aforementioned components are integrated as a single unit, is formed. The process cartridge 30 can be inserted into a cartridge receiving part (not shown) of an image-forming-apparatus housing 27 (see FIG. 10) from the front side and attached thereto, and can be pulled out toward the front side and removed therefrom.

Exposure Device

Figure 3:
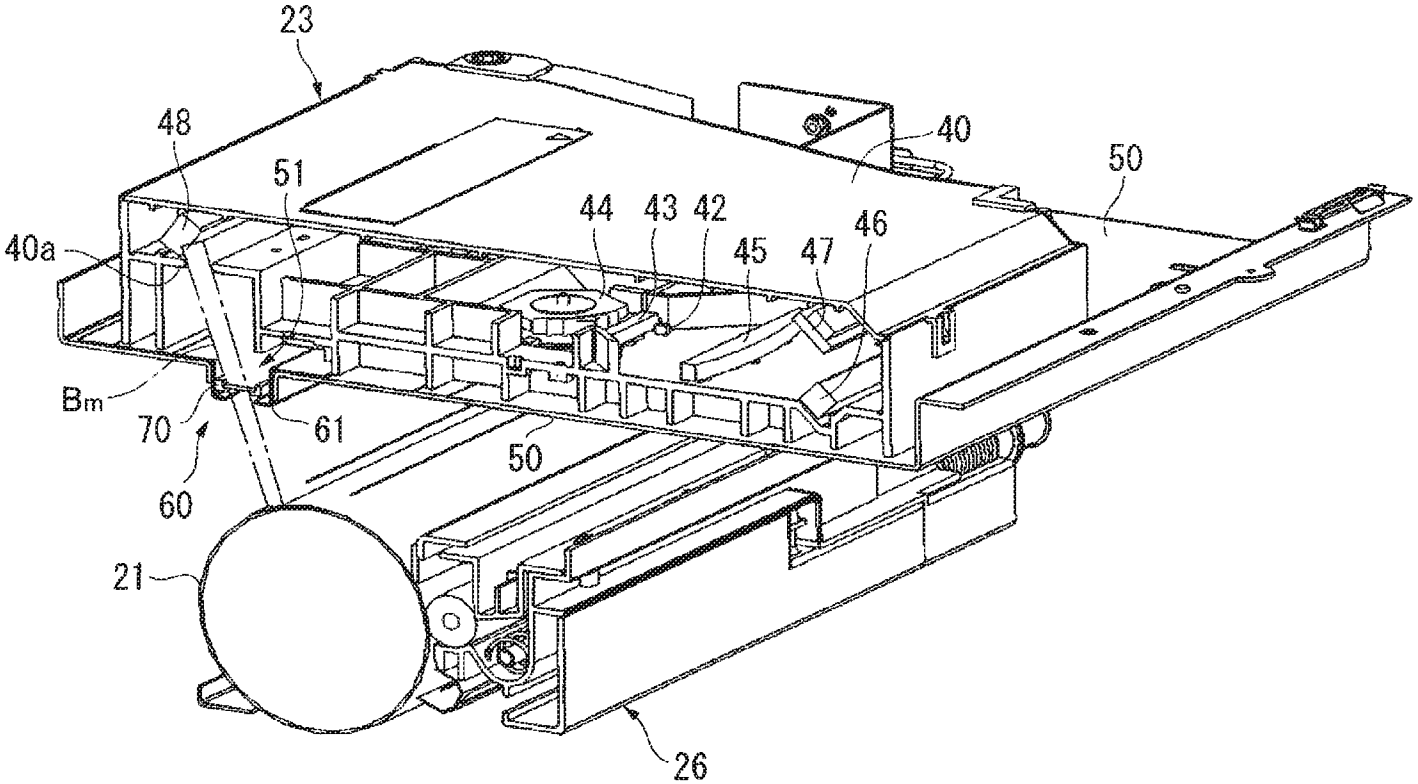
FIG. 3 is a perspective view of the relevant part of the image forming apparatus in FIG. 2.
Figure 5:
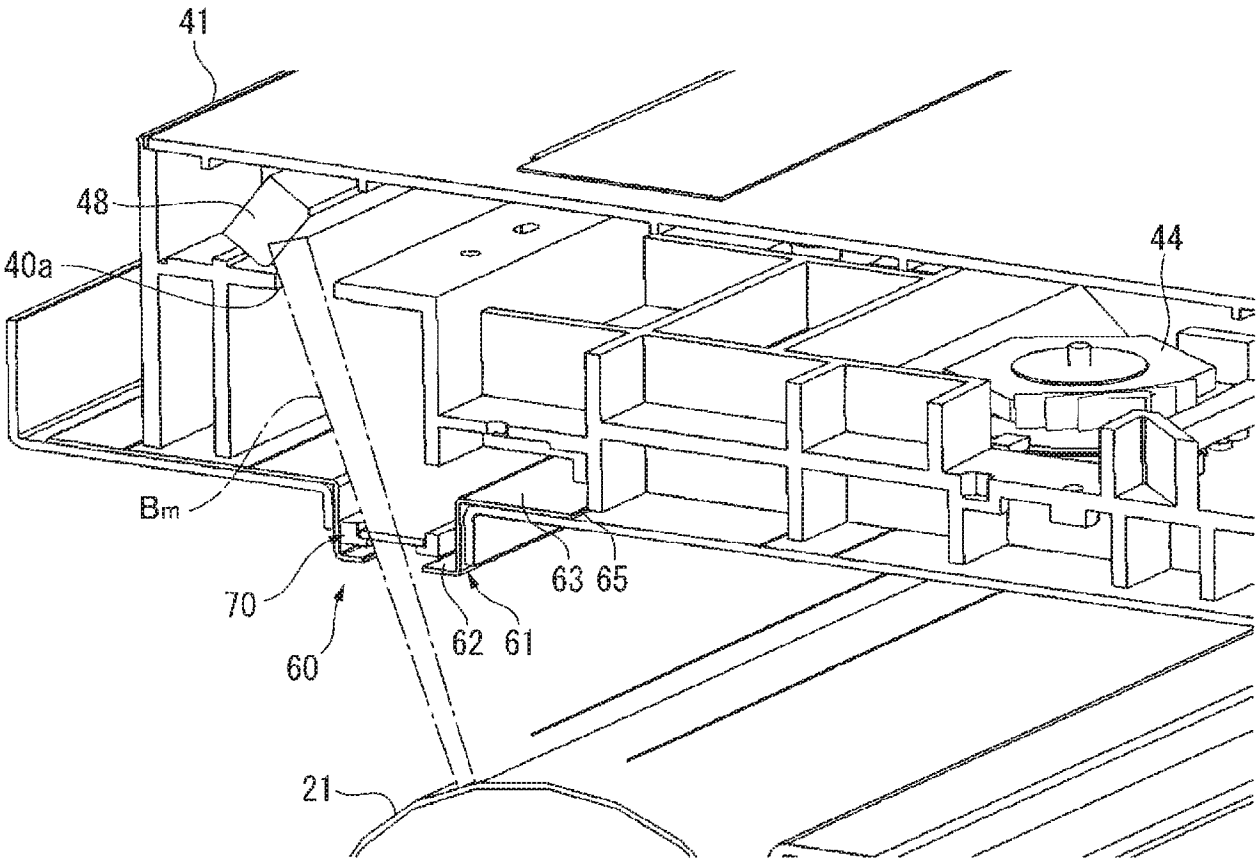
FIG. 5 is a perspective view of the relevant part of the exposure device in FIG. 2.
Figure 6:
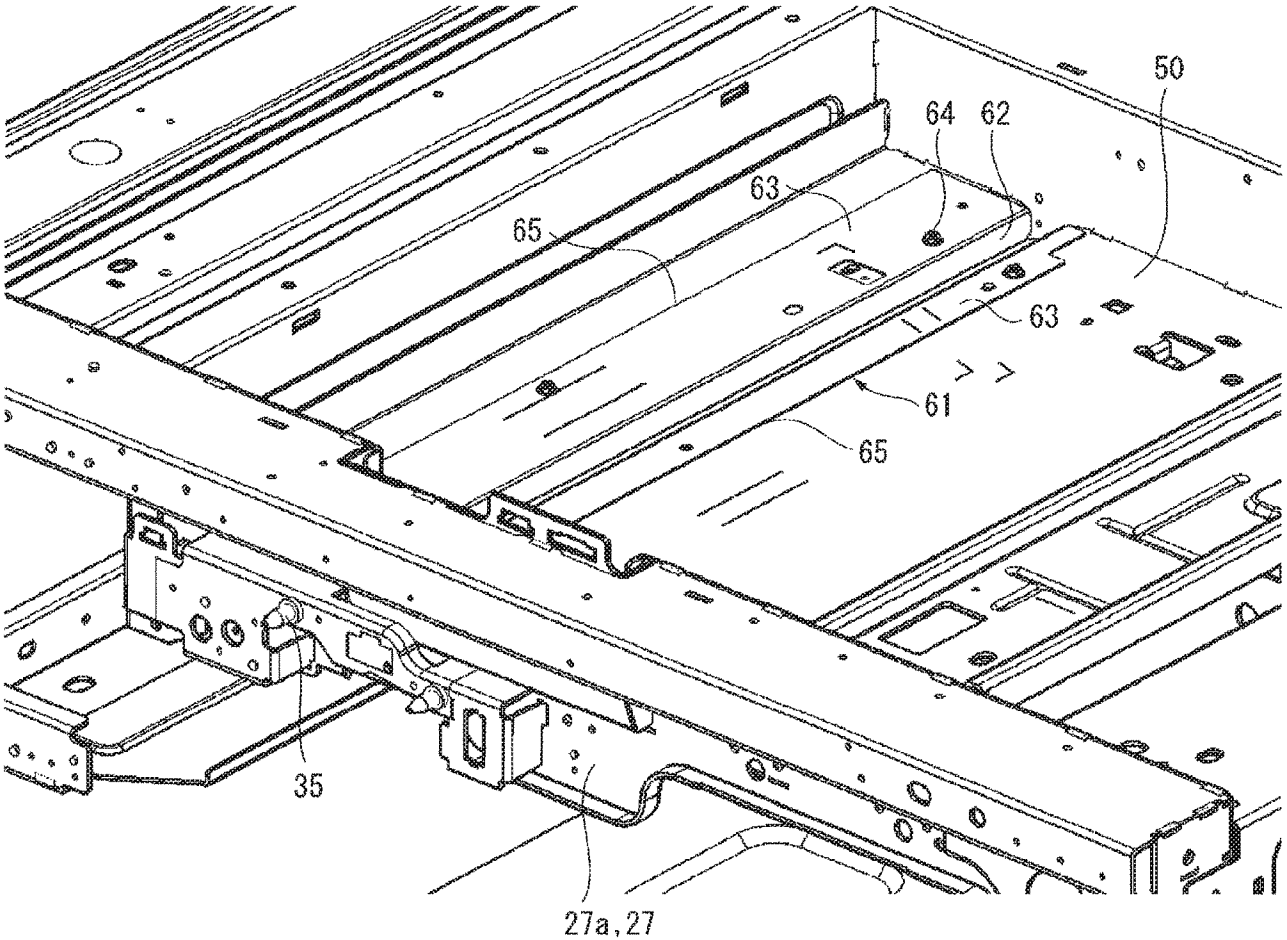
FIG. 6 shows a state in which a receiving bracket (receiving member) for the exposure window component used in the exemplary embodiment is attached.
Figure 7:
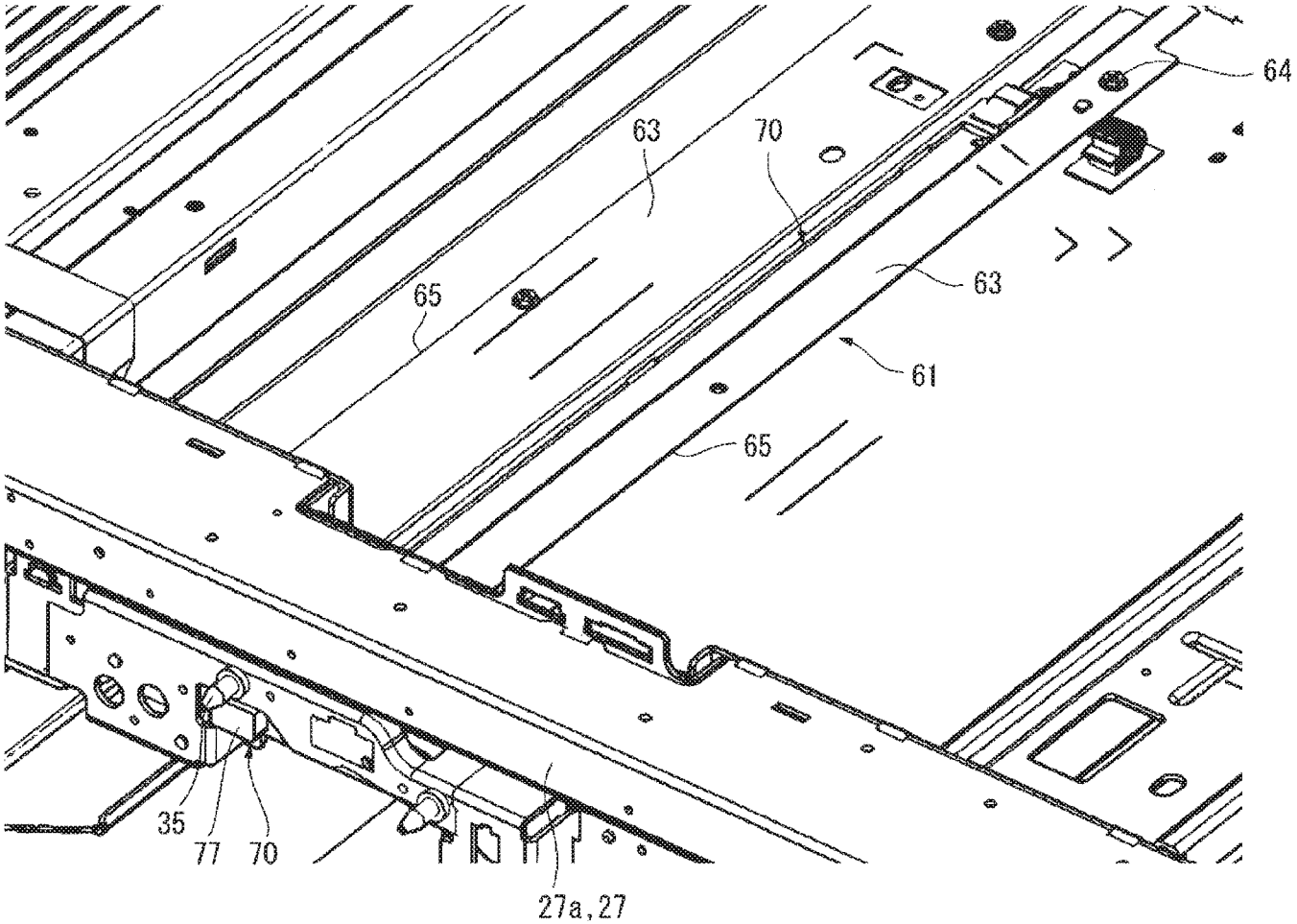
FIG. 7 shows the overall configuration of the exposure window component used in the exemplary embodiment.

In this exemplary embodiment, as shown in FIGS. 2, 3, and 5, the exposure device 23 is formed of a raster device (i.e., a raster output scanner (ROS)) using a laser light source and is disposed above the photoconductor 21 in the process cartridge 30. A support plate 50, which constitutes a portion of the image-forming-apparatus housing 27, is provided between the exposure device 23 and the photoconductor 21 so as to separate them, and an exposure device housing 40 is disposed on the support plate 50. The exposure device housing 40 is formed in a substantially box shape, is stably disposed on the support plate 50 via multiple legs 41, and is fixed to the support plate 50 via attaching brackets (not shown).

Furthermore, in this example, the bottom surface of the exposure device housing 40 is a very small distance z (for example, 2 mm to 5 mm) away from the surface of the support plate 50.

Furthermore, in this example, a light source 42, which is, for example, a semiconductor laser light source, and various optical components that emit the light from the light source 42 as raster-scanning light are built in the exposure device housing 40. Herein, the various optical components include a collimating lens 43 that collimates the beam emitted from the light source 42, a rotary polygon mirror (polygon mirror) 44 that converts the beam passing through the collimating lens 43 into a beam corresponding to each of scanning lines by high-speed rotation, an image-forming lens 45 that forms an image of the beam from the rotary polygon mirror 44 on the photoconductor 21, reflecting mirrors 46 to 48 that form a predetermined optical path in the exposure device housing 40, etc.

Furthermore, a scanning beam Bm is emitted toward the photoconductor 21 from the reflecting mirror 48 provided at the final stage in the exposure device housing 40, and the support plate 50, which intersects the exposure path of the scanning beam Bm, is provided with a slit-shaped elongated passage opening 51 through which the scanning beam passes.

In this example, the scanning beam Bm coming from the reflecting mirror 48 in the exposure device housing 40 exits to the outside of the exposure device housing 40 through a preliminarily formed opening 40*a*, passes through the passage opening 51 in the support plate 50, and reaches the exposure position in the photoconductor 21.

Exposure Window Component

In particular, in this exemplary embodiment, an exposure window component 60 is provided at the passage opening 51 in the support plate 50.

In this example, as shown in FIGS. 2, 3, 5 to 8, the exposure window component 60 includes a receiving bracket 61 that is attached to the passage opening 51 in the support plate 50, and a transmitting unit 70 that is received by the receiving bracket 61 and constitutes the exposure window.

Herein, the receiving bracket 61 is formed by pressing a steel plate having a thickness of, for example, 0.6 mm to 1.0 mm in the form a hat in section. The receiving bracket 61 has an elongated receiving body 62 having a groove shape (in this example, a substantially U-shaped groove shape) in section, and outwardly projecting flanges 63 formed along the longitudinal edges of the receiving body 62. The receiving bracket 61 is held by the passage opening 51 in such a manner that the receiving body 62 is fitted into the passage opening 51, the flanges 63 are hung on the upper edges of the passage opening 51, and the flanges 63 are fixed to the support plate 50 at several portions with fasteners 64, such as screws.

Figure 8:
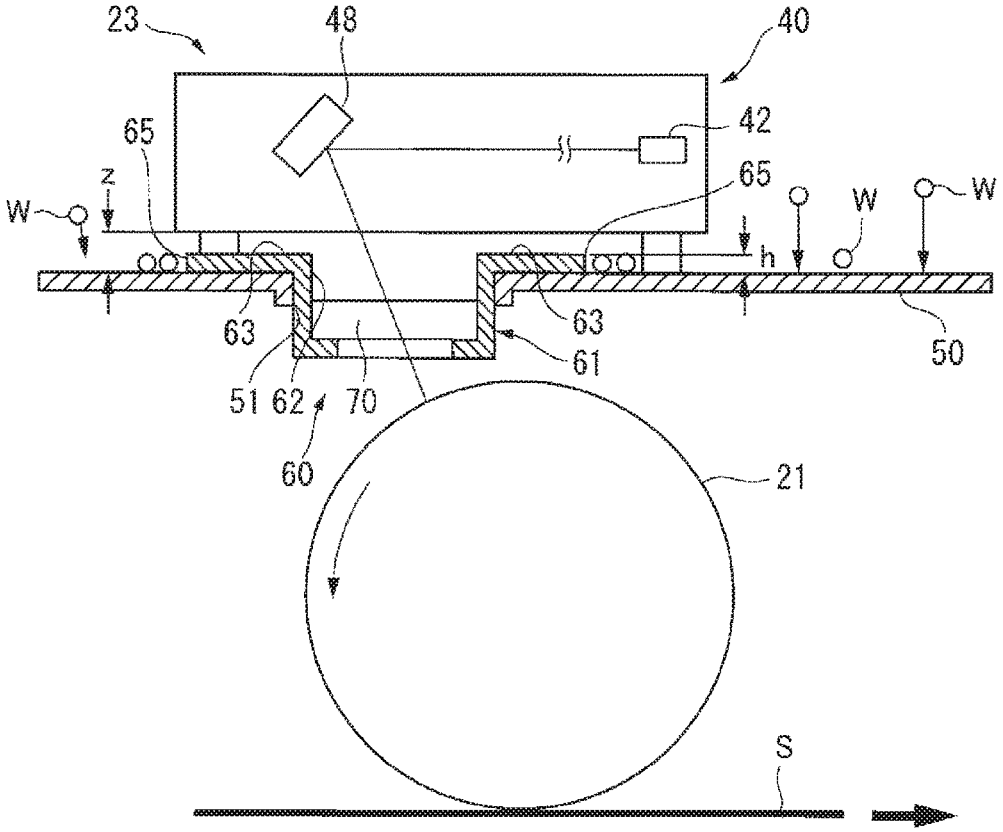
FIG. 8 is a sectional view of the exposure window component used in the exemplary embodiment and the vicinity thereof.

In this example, as particularly shown in FIG. 8, the ends, in the projecting direction, of the flanges 63 of the receiving bracket 61 serve as step portions 65 having a height h (corresponding to the thickness of the flanges 63 in this example) from the surface of the support plate 50.

Figure 13:
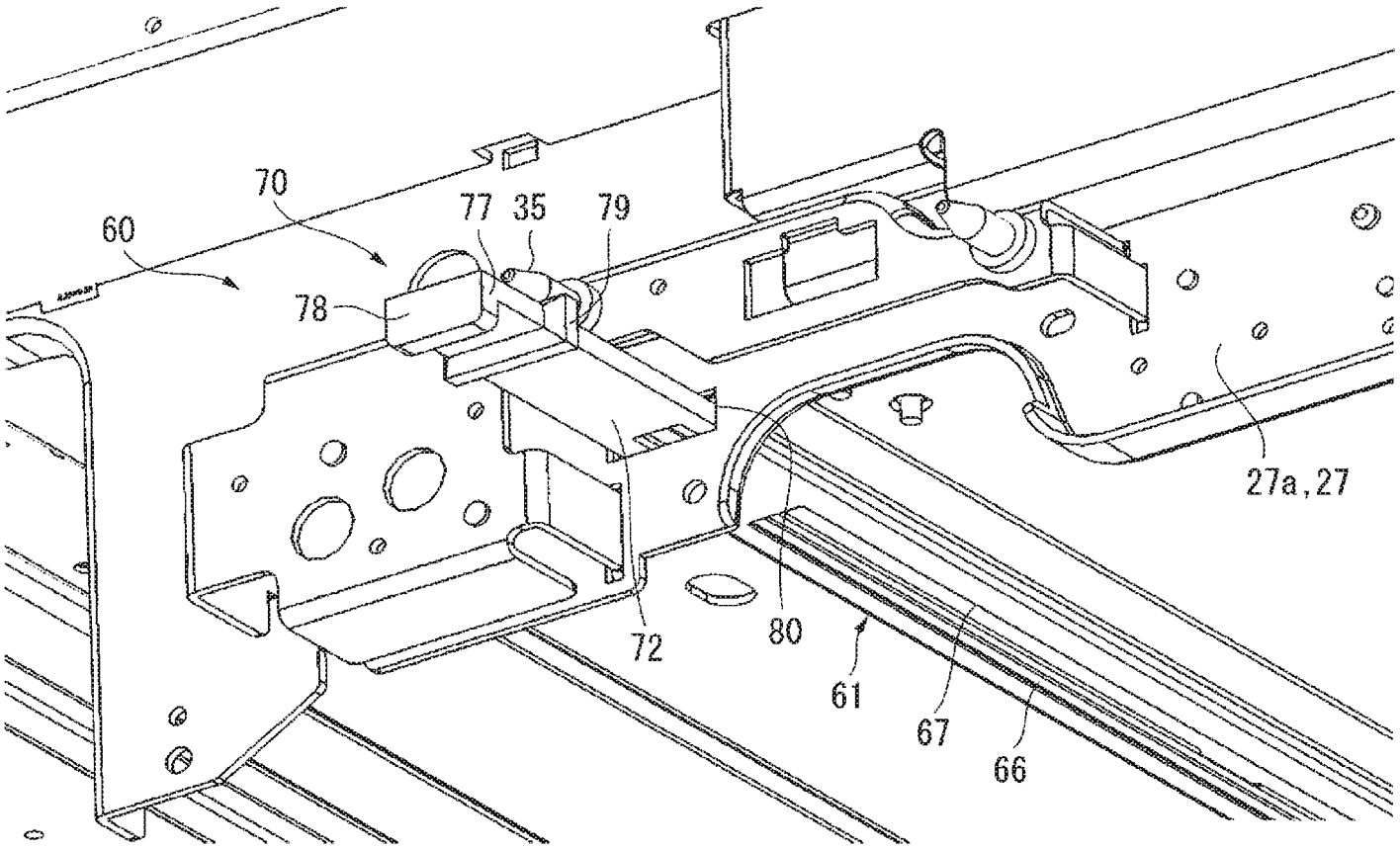
FIG. 13 shows a portion as viewed in a direction pointed by arrow XIII in FIG. 12.

The receiving bracket 61 is provided with, at the bottom of the receiving body 62, a rectangular elongated hole 66 having a size substantially corresponding to the size of a transmitting glass 71 (see FIG. 14, described below) of the transmitting unit 70, so as to leave a peripheral area 67 (see FIG. 13).

The transmitting unit 70 basically includes the transmitting glass 71 that is formed of an elongated glass plate having a width smaller than the width of the receiving body 62 of the receiving bracket 61, and a holding frame 72 that holds the transmitting glass 71 and is formed of a resin, such as modified polyphenylene ether (PPEI) resin. The transmitting unit 70 is received by the bottom of the receiving body 62 of the receiving bracket 61 and is accommodated in the receiving body 62 so as not to project upward from the top surface of the flanges 63.

Hence, in this example, the transmitting unit 70 covers the passage opening 51 in the support plate 50, together with the receiving bracket 61.

The transmitting unit 70 is configured to be removable from the receiving bracket 61. This configuration will be described in detail below.

Peripheral Structure of Exposure Window Component (Exposure Window Structure)

Next, the peripheral structure of the exposure window component 60 according to this exemplary embodiment will be described.

Now, as shown in FIG. 8, it is assumed that there are foreign bodies W, such as metal dust produced by driving screws, on the support plate 50. In this state, for example, if the rotary polygon mirror 44 in the exposure device 23 is rotated, the mechanical vibration produced by the rotation shakes the support plate 50, which may move the foreign bodies W on the support plate 50.

However, in this exemplary embodiment, the maximum particle diameter of the foreign bodies W on the support plate 50 is about 200 μm, and, even if the foreign bodies W are shaken on the support plate 50, the foreign bodies W are blocked by the step portions 65 provided around the passage opening 51 and having a height h from the surface of the support plate 50. Hence, it is considered that there is a very low possibility of the foreign bodies W moving over the step portions 65.

Even if the foreign bodies W move over the step portions 65, because the passage opening 51 is covered by the transmitting unit 70 and the receiving bracket 61, there is no risk of the foreign bodies W that have moved over the step portions 65 falling off the passage opening 51 and reaching the photoconductor 21.

Comparative Embodiment 1

Figure 9:
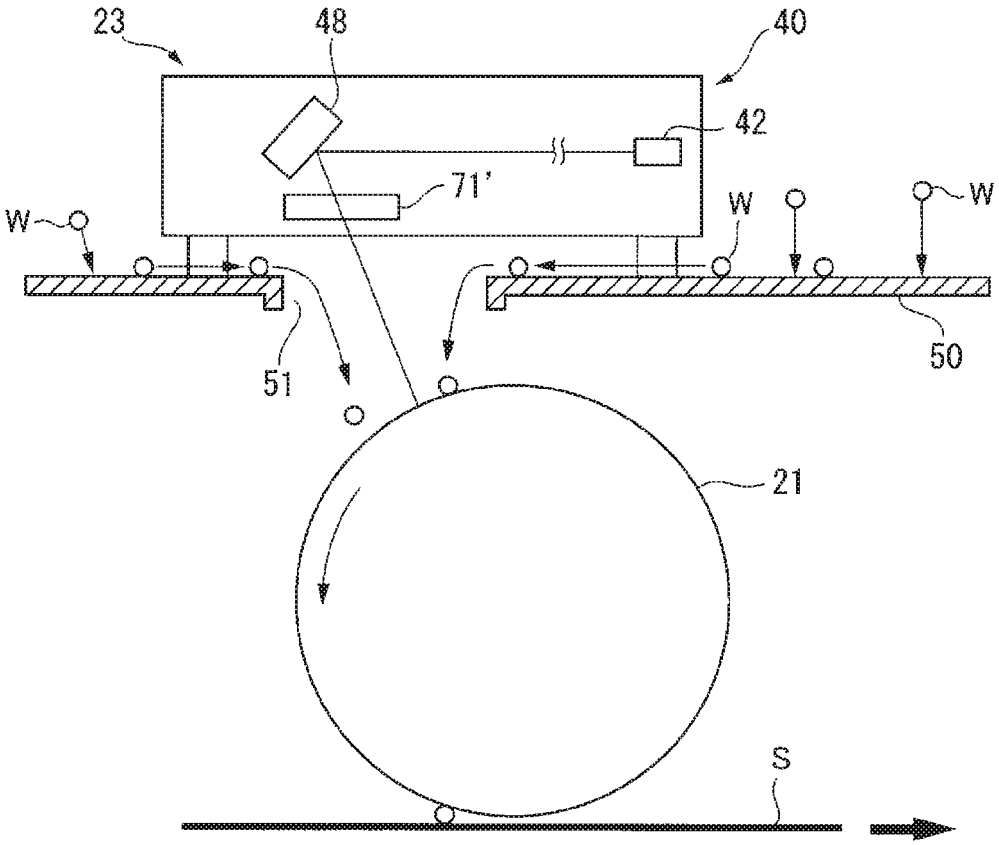
FIG. 9 schematically shows how foreign bodies fall in an image forming apparatus according to Comparative Embodiment 1.

FIG. 9 shows an image forming apparatus according to Comparative Embodiment 1. This image forming apparatus is not provided with the exposure window component 60 according to this exemplary embodiment, but is provided with a transmitting glass 71' in the exposure device housing 40.

It is understood that, in Comparative Embodiment 1, which is not provided with the exposure window component 60 used in the exemplary embodiment, foreign bodies W falling off the passage opening 51 in the support plate 50 are deposited on the surface of the photoconductor 21 and may deteriorate the image quality.

Ease of Cleaning of Exposure Window Component

In this exemplary embodiment, in order to ensure ease of cleaning of the transmitting glass 71, the exposure window component 60 is configured such that the transmitting unit 70 can be inserted into and removed from the receiving bracket 61.

Furthermore, when enabling the insertion and removal of the transmitting unit 70, if the transmitting unit 70 is removed with the photoconductor 21 inside the image-forming-apparatus housing 27, foreign bodies W may fall off the passage opening 51 in the support plate 50 and may be deposited on the surface of the photoconductor 21 at the time when the transmitting unit 70 is pulled out. Hence, removal of the transmitting unit 70 is enabled when the photoconductor 21 is not inside the image-forming-apparatus housing 27, more specifically, only when the process cartridge 30 has been removed.

Positional Relationship Between Process Cartridge and Exposure Window Component

Figure 10:
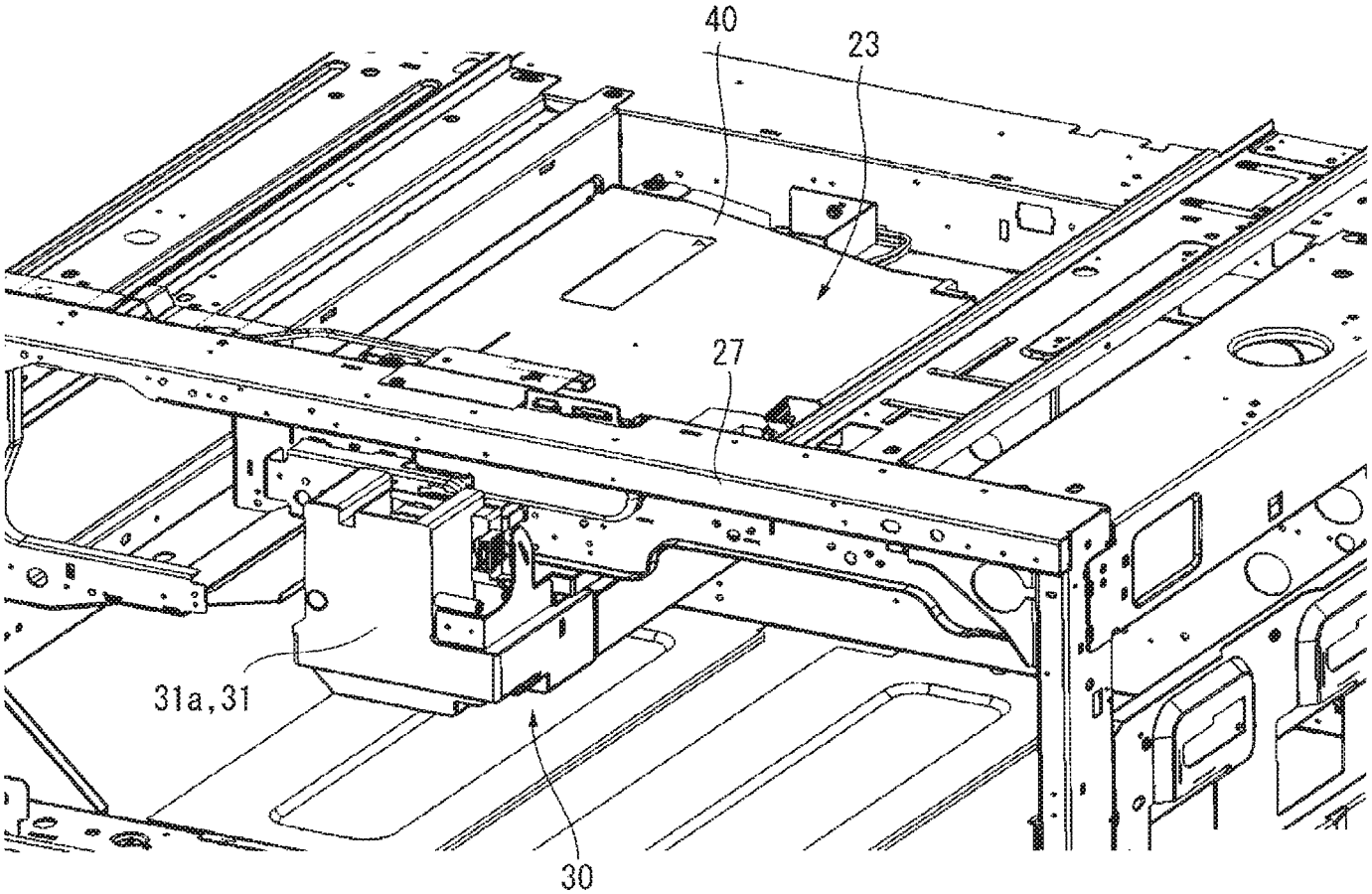
FIG. 10 shows a state in which a process cartridge is attached to the image forming apparatus according to the exemplary embodiment.

In this exemplary embodiment, as shown in FIG. 10, when the process cartridge 30 is attached at a set position in the image-forming-apparatus housing 27, the exposure window component 60 is disposed such that it is hidden behind a front side portion 31*a* of the cartridge housing 31 of the process cartridge 30. Hence, as long as the process cartridge 30 is set, a user cannot touch the exposure window component 60 from the front side.

Figure 11:
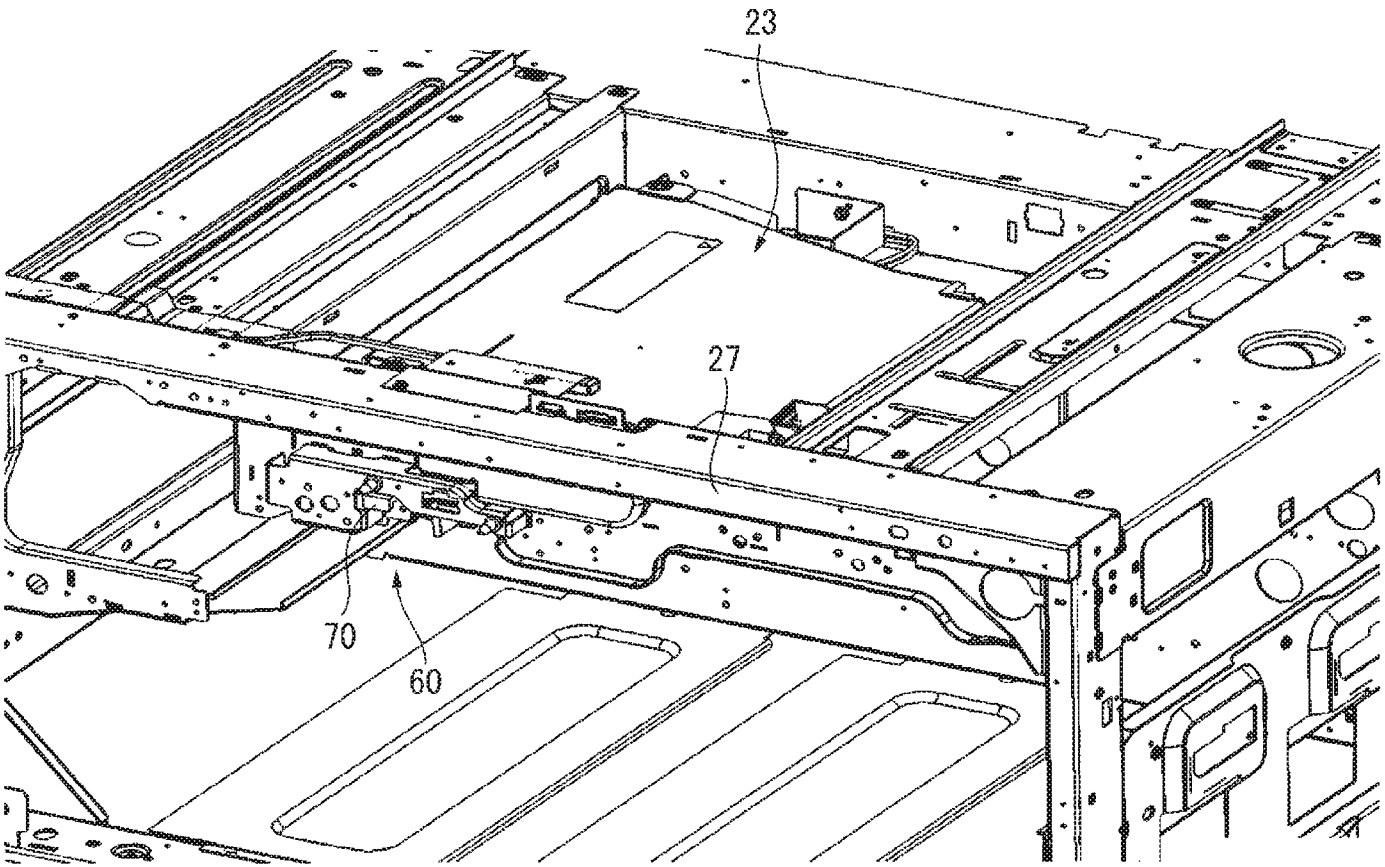
FIG. 11 shows a state in which the process cartridge is removed from the image forming apparatus according to the exemplary embodiment.

Conversely, as shown in FIG. 11, when the process cartridge 30 has been removed from the image-forming-apparatus housing 27, the exposure window component 60 can be operated from the front side of the image-forming-apparatus housing 27.

Insertion and Removal Structure of Transmitting Unit

Figure 12:
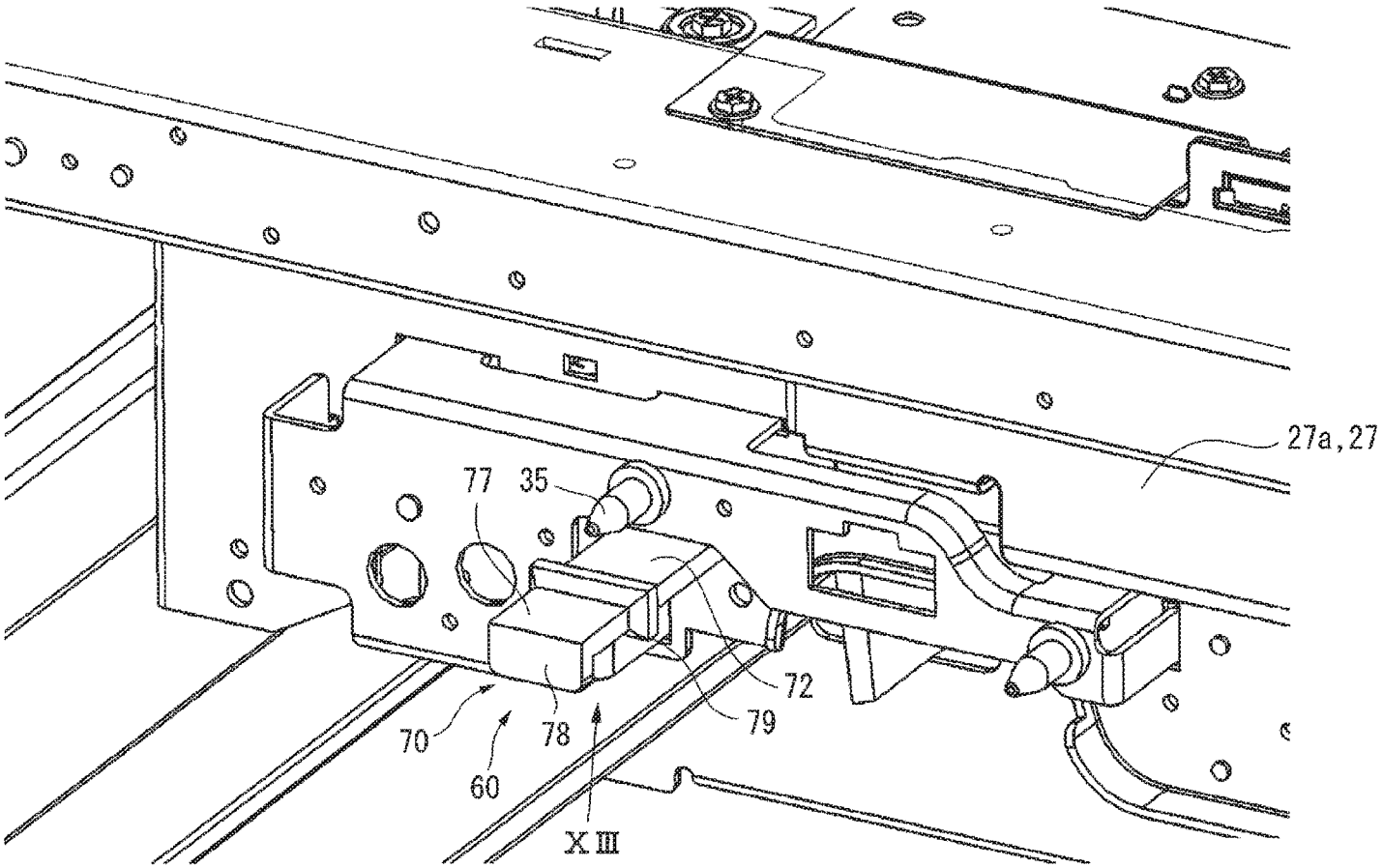
FIG. 12 shows a side in which a transmitting unit of the exposure window component used in the exemplary embodiment is pulled out.
Figure 14:
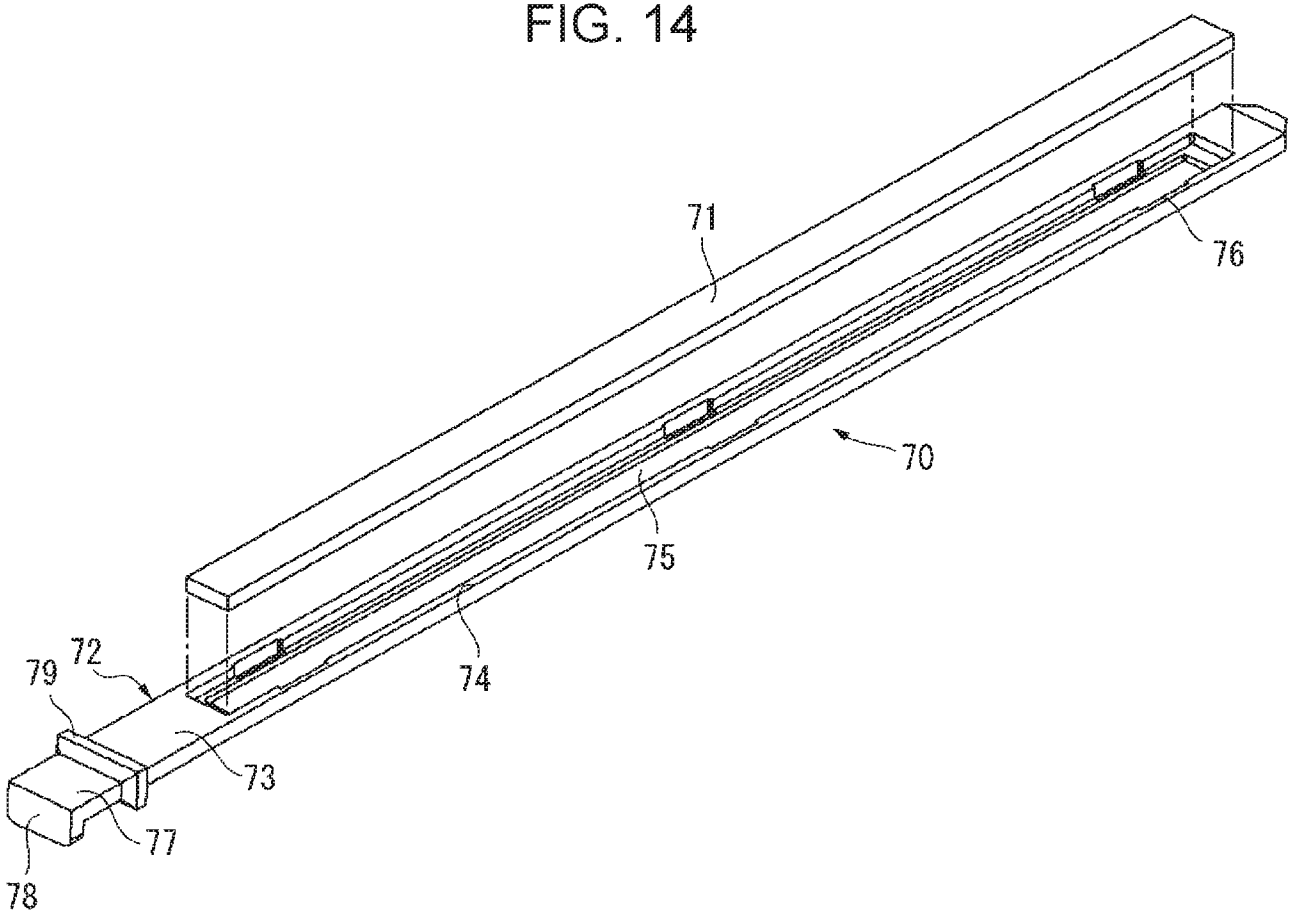
FIG. 14 is a perspective view of the transmitting unit used in the exemplary embodiment.
Figure 15:
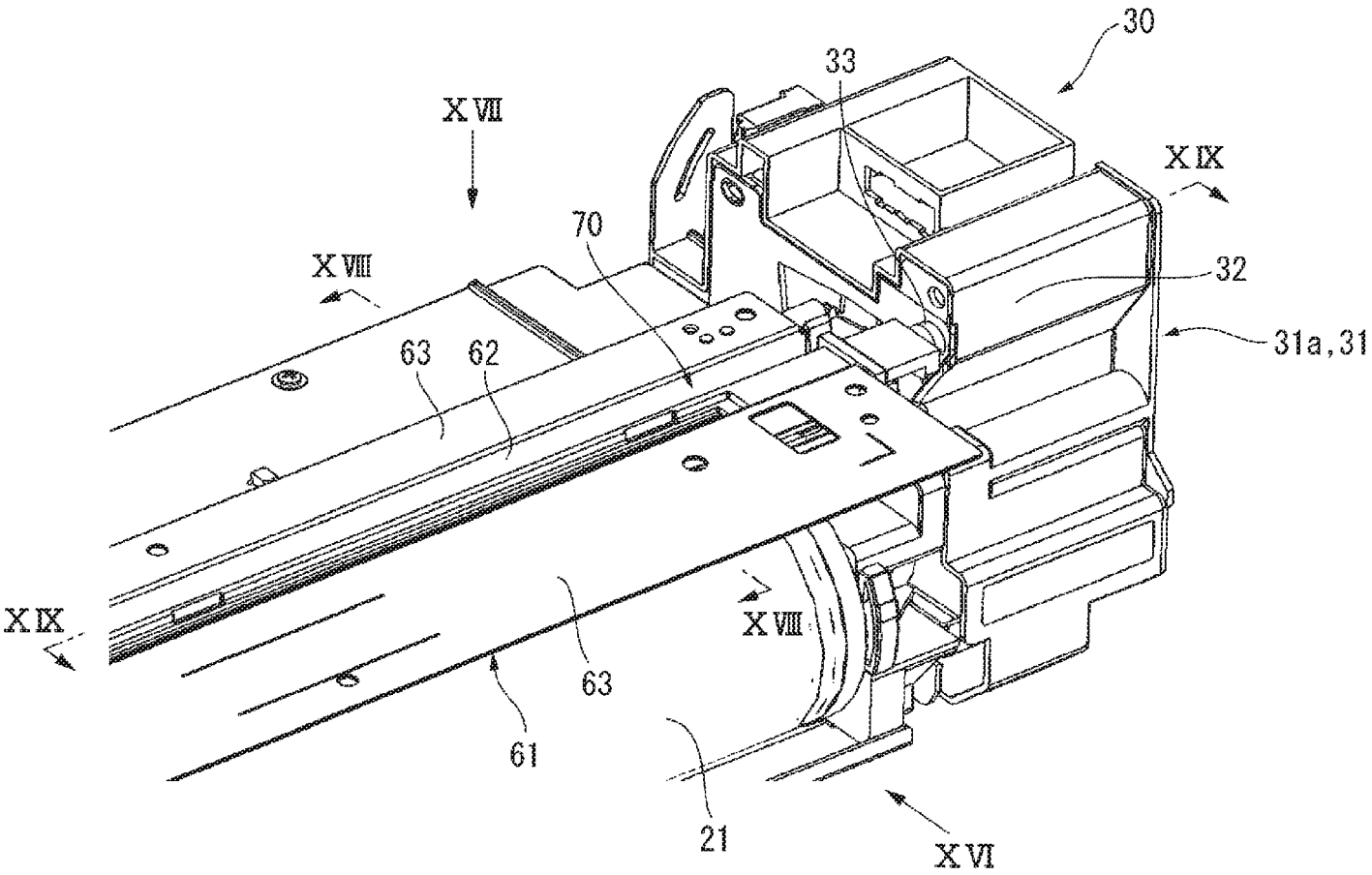
FIG. 15 is a perspective view showing the relative positional relationship between the exposure window component and the process cartridge used in the exemplary embodiment.
Figure 16:
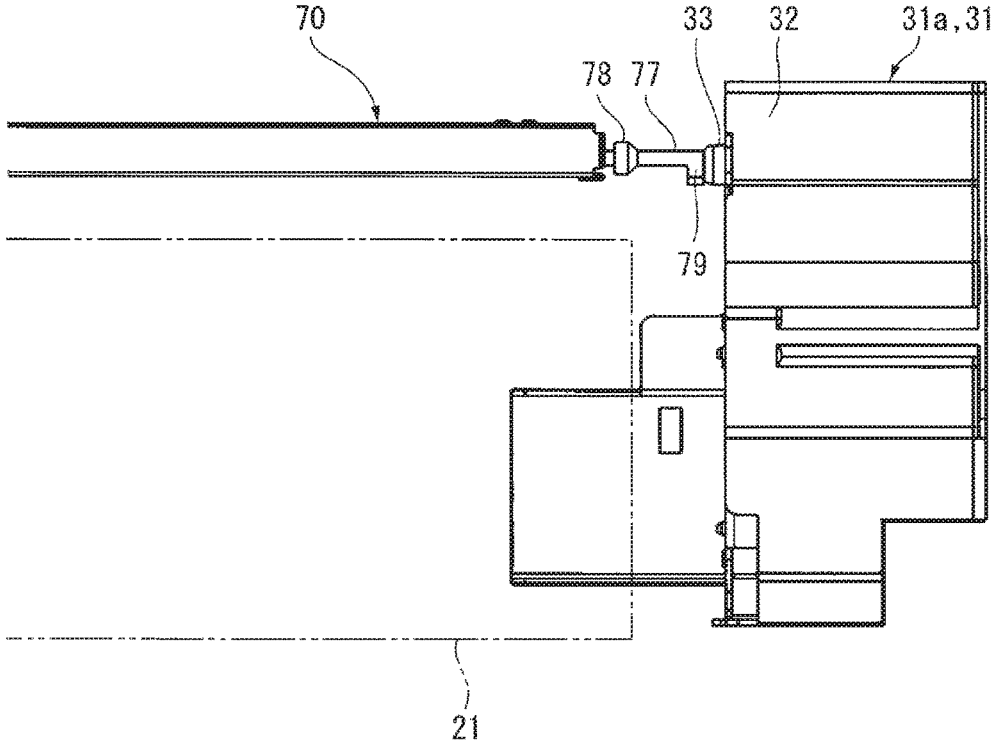
FIG. 16 shows a portion as viewed in a direction pointed by arrow XVI in FIG. 15.
Figure 17:
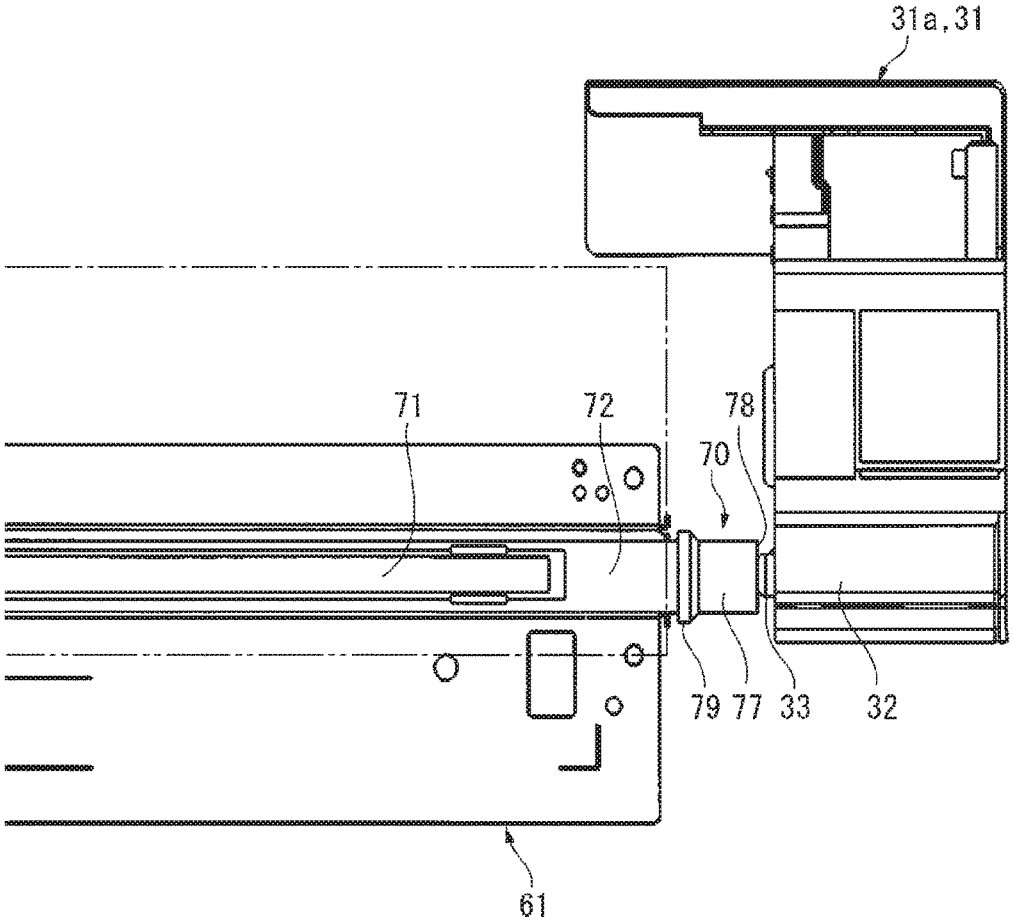
FIG. 17 shows a portion as viewed in a direction pointed by arrow XVII in FIG. 15.
Figure 18:
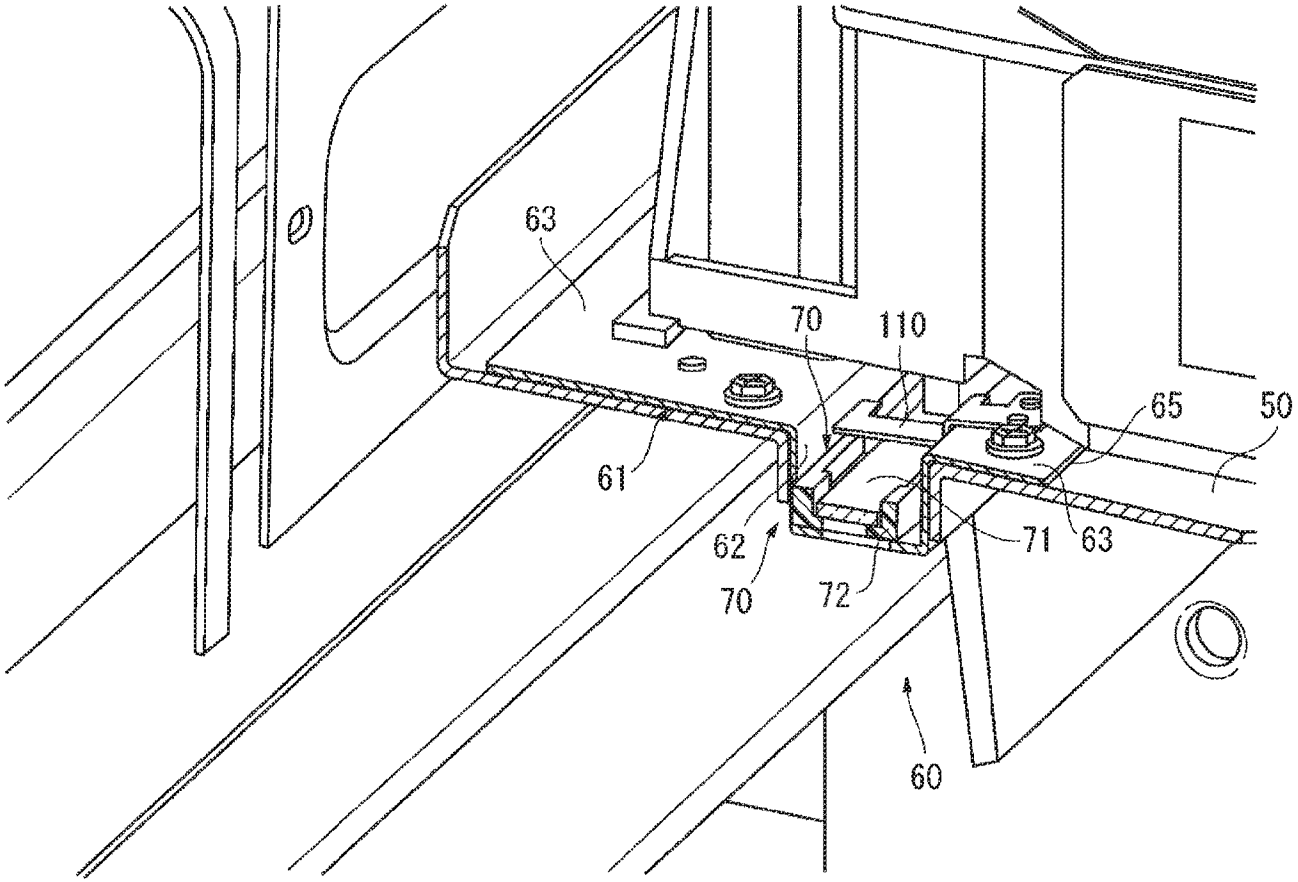
FIG. 18 is a sectional view taken along line XVIII-XVIII in FIG. 15.
Figure 19:
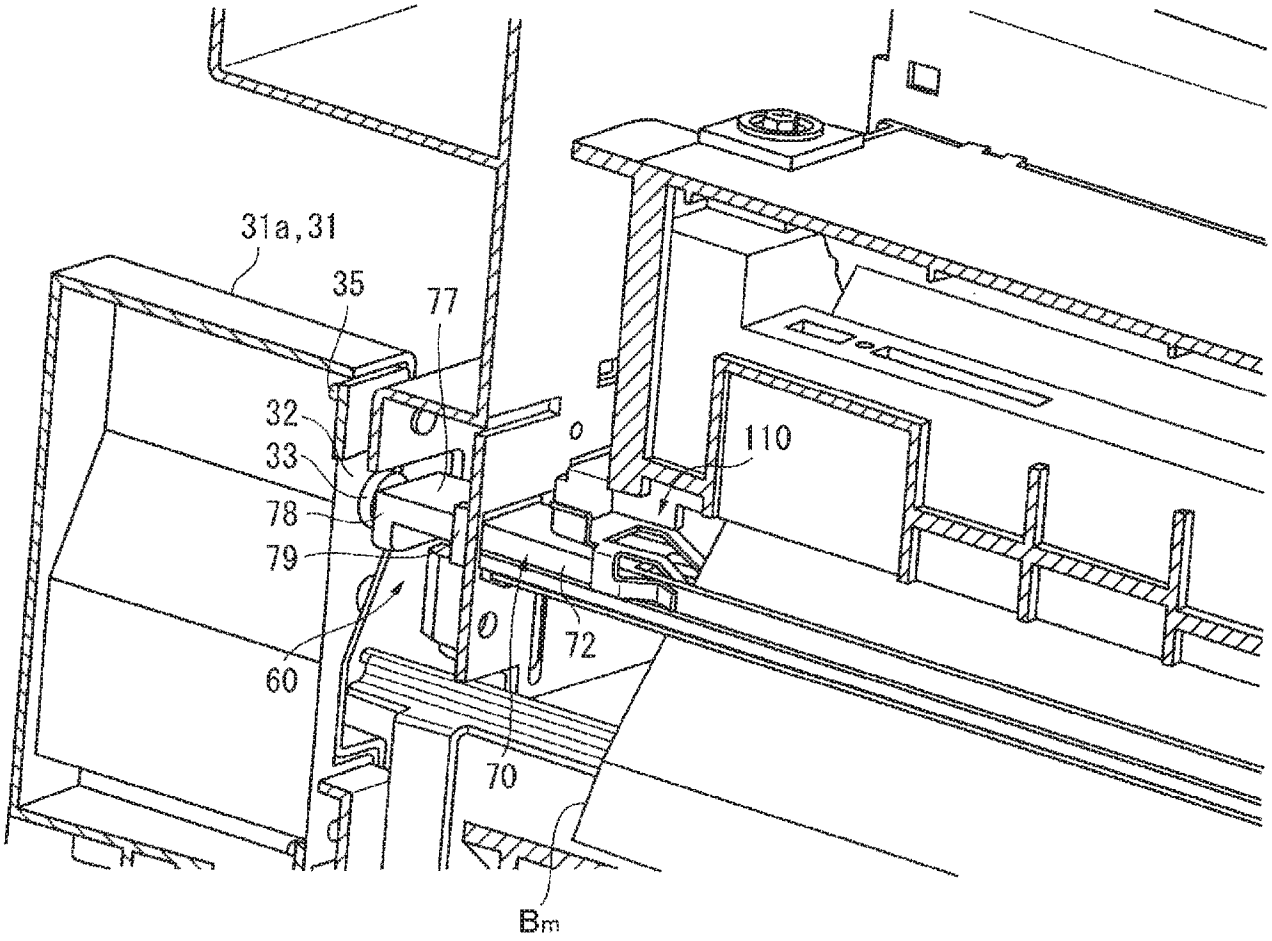
FIG. 19 is a sectional view taken along line XIX-XIX in FIG. 15.

In this example, as shown in FIGS. 12 to 14, the transmitting unit 70 includes the transmitting glass 71 and the holding frame 72. The holding frame 72 includes a plate-shaped frame body 73 provided with a recess 74 to which the transmitting glass 71 is fitted. An elongated rectangular elongated hole 75, which is slightly smaller than the transmitting glass 71, is formed at the bottom of the recess 74. Multiple cut-away grooves 76 are formed around the recess 74. The transmitting glass 71 is removably fitted into the recess 74 via these cut-away grooves 76.

Furthermore, in this example, a grasping part 77 projecting toward the front side of the image-forming-apparatus housing 27 is formed on the holding frame 72. A downwardly bent tab 78 is formed at an end of the grasping part 77, and a flange-shaped stopper piece 79 projecting around the grasping part 77 is formed at a position away from the end of the grasping part 77.

As shown in FIG. 13, the transmitting unit 70 slides in the longitudinal direction of the receiving body 62 of the receiving bracket 61. An insertion port 80 into which the transmitting unit 70 can be inserted is formed in a housing plate 27*a* located at the front side of the image-forming-apparatus housing 27, and, as a result of the stopper piece 79 of the transmitting unit 70 coming into contact with the peripheral edge of the insertion port 80, the insertion position of the transmitting unit 70 is restricted.

Positional Relationship Between Transmitting Unit and Process Cartridge

In this exemplary embodiment, as shown in FIGS. 15 to 18, the front side portion 31*a* of the cartridge housing 31 of the process cartridge 30 has a protruding part 32 protruding toward the portion corresponding to the path along which the transmitting unit 70 is pulled out, and a projection 33 that comes into contact with tab 78 of the transmitting unit 70 is provided on the protruding part 32.

When the process cartridge 30 is inserted and attached at a set position in the image-forming-apparatus housing 27, even in a state in which the transmitting unit 70 is not set at a predetermined set position, the projection 33 comes into contact with the tab 78 and presses the transmitting unit 70 into the predetermined set position.

A positioning pin 35 for positioning the process cartridge 30 is provided on the housing plate 27*a* of the image-forming-apparatus housing 27 (see FIG. 6), and a positioning hole (not shown), into which the positioning pin 35 is fitted, is provided in the front side portion 31*a* of the cartridge housing 31 of the process cartridge 30.

Positioning Structure of Transmitting Unit

In this exemplary embodiment, as shown in FIGS. 18 to 22, when the transmitting unit 70 is inserted into a predetermined set position in the receiving bracket 61, the transmitting unit 70 is positioned by a first positioning mechanism 110 and a second positioning mechanism 120 provided at the front side and the rear side of the receiving bracket 61 in the longitudinal direction.

In this example, as shown particularly in FIGS. 18 to 21, the first positioning mechanism 110 is configured such that a pair of upper pressing springs 111 and 112, which are provided at both widthwise sides of the holding frame 72 of the transmitting unit 70 and elastically press the holding frame 72 from above, and a side pressing spring 113, which is provided at one widthwise side of the holding frame 72 and elastically presses the holding frame 72 toward the other widthwise side, are integrally formed on an attachment plate 114, and the attachment plate 114 is fixed with a fastener 115, such as a screw.

Figure 20:
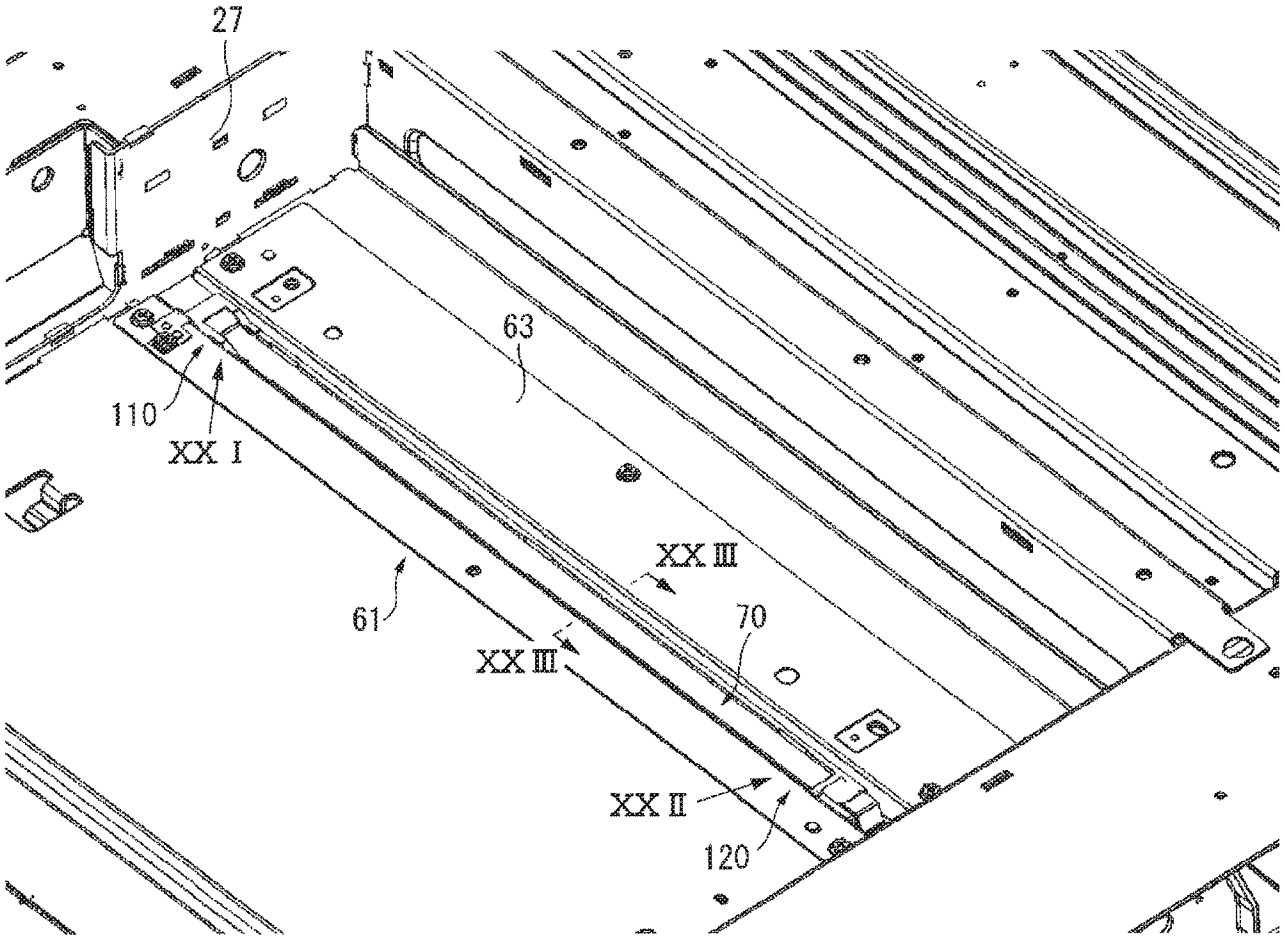
FIG. 20 shows a positioning structure for positioning the transmitting unit of the exposure window component used in the exemplary embodiment with respect to a guide bracket.
Figure 21:
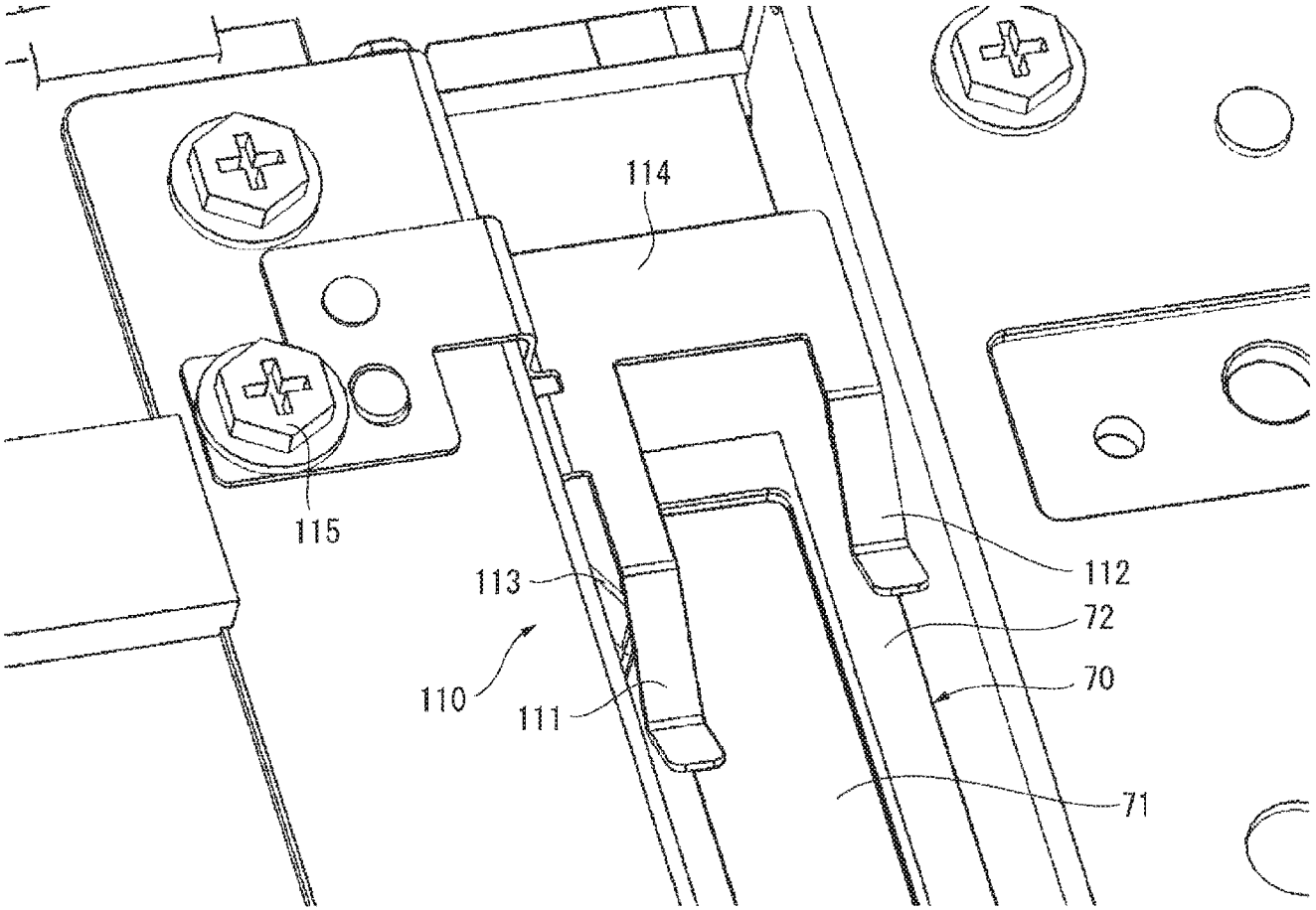
FIG. 21 is an enlarged view of part XXI in FIG. 20.
Figure 22:
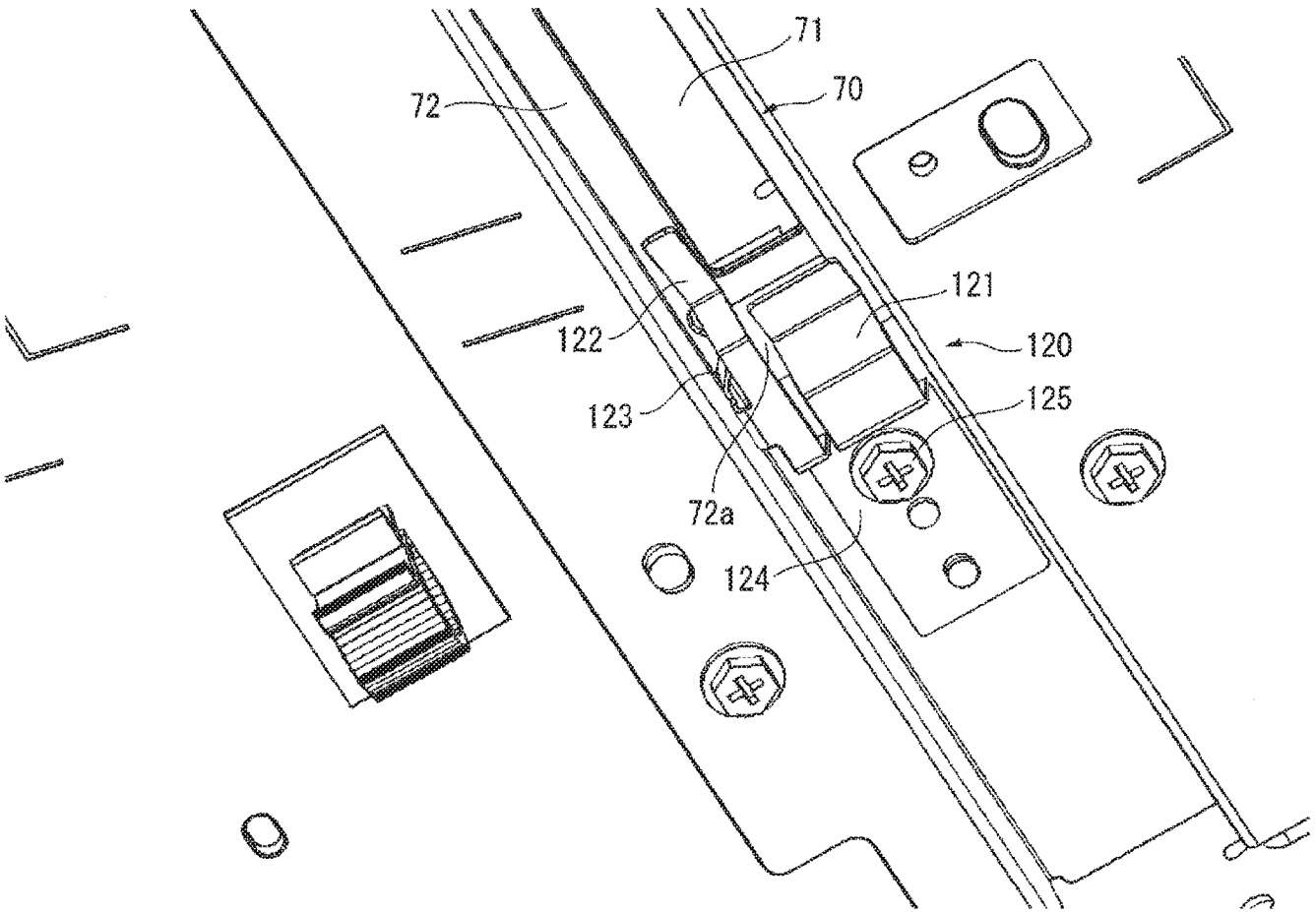
FIG. 22 is an enlarged view of part XXII in FIG. 20.

Meanwhile, as shown in FIGS. 20 and 22, the second positioning mechanism 120 is configured such that a plate-shaped upper pressing spring 121, which elastically presses a large part of a rear side portion 72*a* of the holding frame 72 of the transmitting unit 70 from above, an upper pressing spring 122, which is longer than the upper pressing spring 121 and elastically presses one widthwise side of the holding frame 72 located at a widthwise side of the transmitting glass 71 from above, and a side pressing spring 123, which is provided at one widthwise side of the holding frame 72 and elastically presses the holding frame 72 toward the other widthwise side, are integrally formed on an attachment plate 124, and the attachment plate 124 is fixed with a fastener 125, such as a screw.

In particular, in this example, when the transmitting unit 70 is inserted along the receiving body 62 of the receiving bracket 61, the receiving body 62 serves as a guide part for the transmitting unit 70. Furthermore, the transmitting unit 70 always passes through the first positioning mechanism 110 to reach the second positioning mechanism 120. Hence, it is desirable to set the elastic urging forces of the pressing springs 111 to 113 of the first positioning mechanism 110 smaller than those of the pressing springs 121 to 123 of the second positioning mechanism 120.

Slidability of Transmitting Unit

Figure 23A:
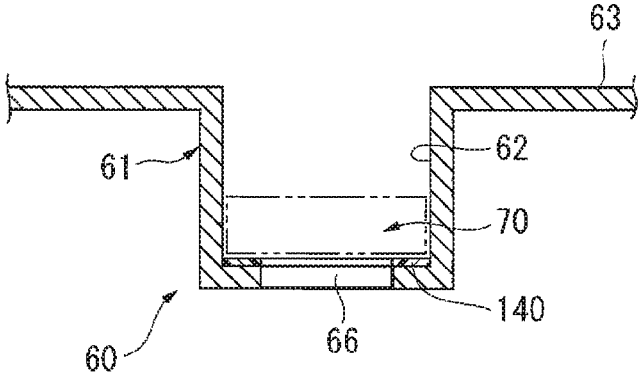
FIG. 23A is a sectional view taken along line XXIII-XXIII in FIG. 20.

In this exemplary embodiment, as shown in FIG. 23A, an elastic seal 140 made of urethane resin, which has low sliding resistance, is provided at the bottom of the receiving body 62 of the receiving bracket 61. Hence, the frictional resistance between the holding frame 72 of the transmitting unit 70 and the bottom of the receiving body 62 is small, and correspondingly, the force needed for insertion and removal of the transmitting unit 70 is reduced.

Furthermore, because the elastic seal 140 ensures the airtightness with respect to the transmitting unit 70, the airtightness between the transmitting unit 70 and the receiving bracket 61 is also maintained in a good condition, which is desirable.

Note that the elastic seal 140 may be provided on the holding frame 72 of the transmitting unit 70, not the receiving bracket 61.

Transmitting Unit Set Position Check

In this exemplary embodiment, it is desirable to provide a position detector 150 for checking whether the transmitting unit 70 is set at the predetermined position.

Figure 23B:
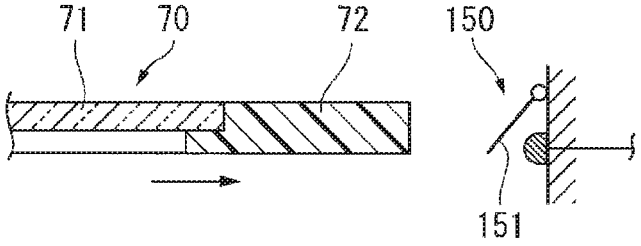
FIG. 23B shows an example of how to detect if the transmitting unit has been set in a predetermined position.

The position detector 150 may include, as shown in, for example, FIG. 23B, a micro switch 151 that is provided at the rear side of the receiving body 62 of the receiving bracket 61. When the rear end of the transmitting unit 70 turns the micro switch 151 on, reaching of the transmitting unit 70 to the set position is detected.

Figure 23C:
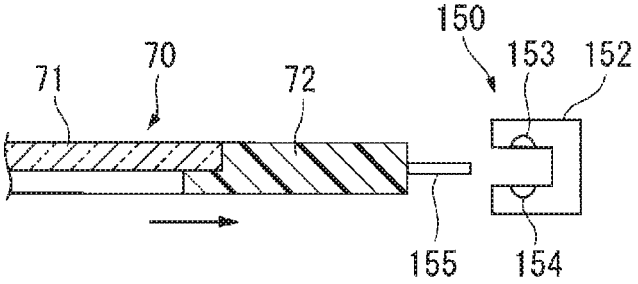
FIG. 23C shows another example of how to detect if the transmitting unit has been set in a predetermined position.

Another example of the position detector 150 may include, as shown in FIG. 23C, a photocoupler 152 in which, for example, a light-emitting element 153 and a light-receiving element 154 are disposed face-to-face and which is provided at the rear side of the receiving body 62 of the receiving bracket 61, and a light-shielding piece 155 provided at the rear end of the transmitting unit 70. When the light-shielding piece 155 reaches a position where it blocks the optical path of the photocoupler 152, reaching of the transmitting unit 70 to the set position is detected.

Attachment and Removal of Exposure Window Component

Next, attachment and removal of the exposure window component according to this exemplary embodiment will be described.

Figure 24A:
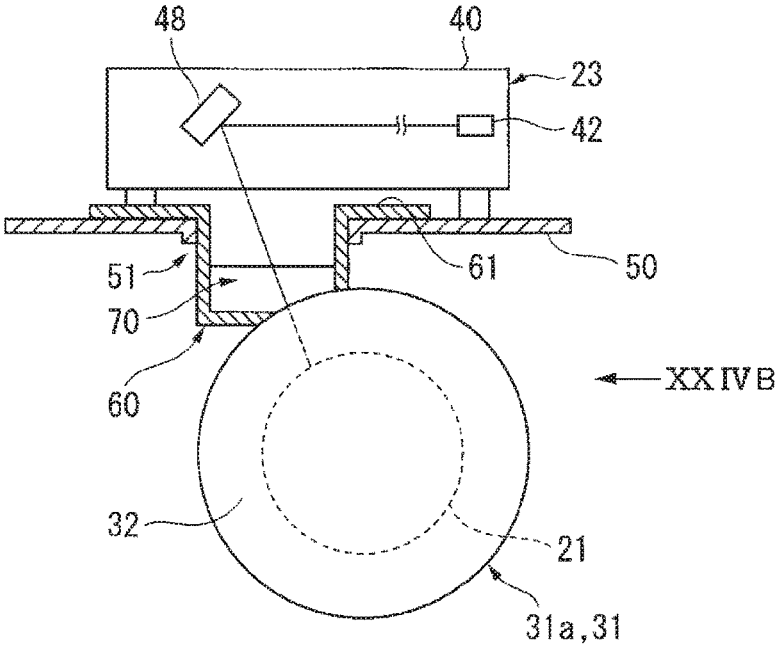
FIG. 24A shows attachment and removal of the transmitting unit used in the exemplary embodiment.
Figure 24B:
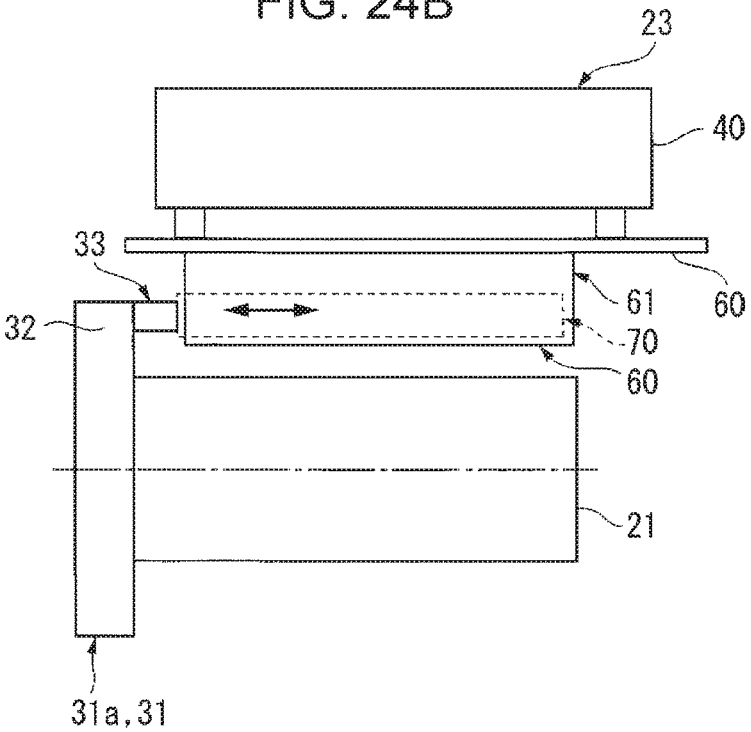
FIG. 24B shows a portion as viewed in a direction pointed by arrow XXIVB in FIG. 24A.

As shown in FIG. 10, assuming that the process cartridge 30 is attached at the set position in the image-forming-apparatus housing 27, as shown in FIGS. 24A and 24B, the protruding part 32 at the front side portion 31*a* of the cartridge housing 31 (in FIGS. 24A and 24B, it is schematically illustrated as a concentric protruding part) is located at a position where it prevents removal of the transmitting unit 70. Hence, a user cannot access or remove the transmitting unit 70 without removing the process cartridge 30 from the set position.

In contrast, as shown in FIG. 11, in a state in which the process cartridge 30 has been removed from the set position, the user can access the transmitting unit 70, and thus, the user can remove the transmitting unit 70 by holding the tab 78 of the grasping part 77. At this time, the front and rear sides of the transmitting glass 71 of the transmitting unit 70 can be cleaned, and after cleaning, the transmitting unit 70 may be inserted until it reaches the predetermined set position.

At this time, even if the inserted transmitting unit 70 does not reach the set position and remains unset, as shown in FIGS. 24A and 24B, the projection 33 provided on the protruding part 32 of the front side portion 31*a* of the cartridge housing 31 comes into contact with the tab 78 of the transmitting unit 70 in the process of inserting and attaching the process cartridge 30 to the set position in the image-forming-apparatus housing 27, and thus, can push the transmitting unit 70 to the predetermined set position.

Comparative Embodiment 2

Figure 25:
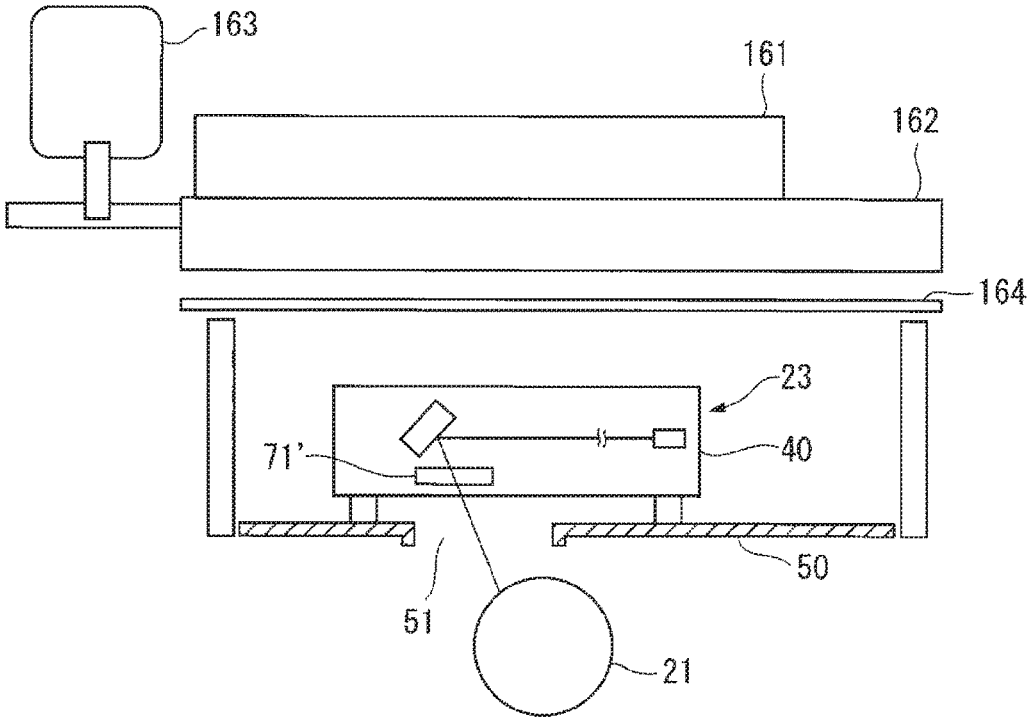
FIG. 25 shows cleaning of an exposure window component of an image forming apparatus according to Comparative Embodiment 2.

In Comparative Embodiment 2, in which the exposure window component 60 as shown in this exemplary embodiment is not used, a transmitting glass 71' is built in the exposure device housing 40, as shown in FIG. 25. Hence, in order to remove the exposure device 23, for example, an automatic two-side document feeding device 161, an image reading device 162, a user interface (UI) 163, and a top surface panel 164 supporting the aforementioned components, which are disposed above the exposure device 23 of the image forming apparatus 20, need to be removed. Then, the exposure device 23 is removed, and the transmitting glass 71' built in the exposure device housing 40 is cleaned. It is understood that the cleaning is difficult. Furthermore, in Comparative Embodiment 2, although it is possible to clean the outside surface of the transmitting glass 71', which faces the outside, it is difficult to clean the inside surface. Hence, there is an inconvenience that only a single side can be cleaned.

The foregoing description of the exemplary embodiment of the present invention has been provided for the purposes of illustration and description. It is not intended to be exhaustive or to limit the invention to the precise forms disclosed. Obviously, many modifications and variations will be apparent to practitioners skilled in the art. The embodiment was chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. An exposure window component that is provided so as to be separated from an exposure device housing and that is attached to an opening through which light from the exposure device housing passes, the exposure window component comprising:

a transmitting member configured to allow light from the exposure device housing to pass therethrough;

a holding frame configured to hold the transmitting member;

a receiving member that is provided at a periphery of the opening;

wherein the receiving member is configured to receive the holding frame when the transmitting member is attached, and wherein the receiving member removably supports the transmitting member; and a grasping part that is provided at a portion of the holding frame, wherein the grasping part is configured to be grasped when the transmitting member is attached and removed, and wherein the receiving member includes a position detector for detecting whether the transmitting member has been attached to a predetermined position.

2. The exposure window component according to claim 1, wherein the opening is provided in a support member, on which the exposure device housing is disposed, and is configured to serve as a passage opening, through which the light from the exposure device housing passes.

3. The exposure window component according to claim 1, wherein the opening is an elongated opening, wherein the transmitting member is formed as an elongated member extending along the elongated opening, and wherein the grasping part is provided at a portion of the holding frame located at one longitudinal end portion of the transmitting member and is configured to allow insertion and removal of the transmitting member in a longitudinal direction.

4. The exposure window component according to claim 1, wherein the receiving member has a guide part configured to guide the holding frame in a sliding manner along the periphery of the opening.

5. The exposure window component according to claim 1, wherein the receiving member has a resin seal having low sliding resistance on a surface thereof that is configured to receive the holding frame.

6. The exposure window component according to claim 1, wherein the receiving member has positioning parts capable of positioning, on a holding-frame receiving surface extending along the periphery of the opening, the holding frame at a plurality of portions in a direction along the periphery of the opening.

7. An exposure window component that is provided so as to be separated from an exposure device housing and that is attached to an opening through which light from the exposure device housing passes, the exposure window component comprising:

a transmitting member configured to allow light from the exposure device housing to pass therethrough;

a holding frame configured to hold the transmitting member;

a receiving member that is provided at a periphery of the opening;

wherein the receiving member is configured to receive the holding frame when the transmitting member is attached, and wherein the receiving member removably supports the transmitting member; and a grasping part that is provided at a portion of the holding frame, wherein the grasping part is configured to be grasped when the transmitting member is attached and removed, and wherein the grasping part has, at an end thereof, a tab for enabling the transmitting member to be pulled out.

8. An exposure device comprising:

an exposure device housing disposed on a support member;

an exposure light source provided in the exposure device housing;

an optical component that is provided in the exposure device housing and is configured to guide light from the light source to an outside of the exposure device housing along a predetermined optical path; and an exposure window component that is provided so as to be separated from the exposure device housing and that is attached to an opening through which light from the exposure device housing passes, the exposure window component comprising:

a transmitting member configured to allow light from the exposure device housing to pass therethrough;

a holding frame configured to hold the transmitting member;

a receiving member that is provided at a periphery of the opening;

wherein the receiving member is configured to receive the holding frame when the transmitting member is attached, and wherein the receiving member removably supports the transmitting member; and a grasping part that is provided at a portion of the holding frame, wherein the grasping part is configured to be grasped when the transmitting member is attached and removed, wherein the exposure device further comprises an image carrier that carries an electrostatic latent image, wherein the image carrier is capable of being inserted and removed in a rotation axis direction, and wherein the exposure window component is configured to allow the grasping part to be grasped if the image carrier has been removed.

9. An image forming apparatus comprising:

the exposure device according to claim 8, wherein the exposure device is configured to radiate light onto the image carrier to form an electrostatic latent image thereon.

10. The image forming apparatus according to claim 9, wherein the image carrier has, at an end thereof in a direction in which the image carrier is removable, a protruding part protruding in a radial direction, and wherein the protruding part has a projection configured to press the holding frame of the exposure window component to a predetermined position.

11. The exposure window component according to claim 7, wherein the opening is provided in a support member, on which the exposure device housing is disposed, and is configured to serve as a passage opening, through which the light from the exposure device housing passes.

12. The exposure window component according to claim 7, wherein the opening is an elongated opening, wherein the transmitting member is formed as an elongated member extending along the elongated opening, and wherein the grasping part is provided at a portion of the frame located at one longitudinal end portion of the transmitting member and is configured to allow insertion and removal of the transmitting member in a longitudinal direction.

13. The exposure window component according to claim 7, wherein the receiving member has a guide part configured to guide the frame in a sliding manner along the periphery of the opening.

14. The exposure window component according to claim 7, wherein the receiving member has a resin seal having low sliding resistance on a surface thereof that is configured to receive the frame.

15. The exposure window component according to claim 7, wherein the receiving member has positioning parts capable of positioning, on a holding-frame receiving surface extending along the periphery of the opening, the frame at a plurality of portions in a direction along the periphery of the opening.

* * * * *